US008752244B2

(12) United States Patent
Talpe

(10) Patent No.: US 8,752,244 B2
(45) Date of Patent: Jun. 17, 2014

(54) DOOR CLOSING MECHANISM

(76) Inventor: Joseph Talpe, Heestert-Zwevegem (BE)

( * ) Notice: Subject to any disclaimer, the term of this patent is extended or adjusted under 35 U.S.C. 154(b) by 31 days.

(21) Appl. No.: 13/392,406

(22) PCT Filed: Aug. 27, 2010

(86) PCT No.: PCT/EP2010/062539
§ 371 (c)(1),
(2), (4) Date: May 16, 2012

(87) PCT Pub. No.: WO2011/023793
PCT Pub. Date: Mar. 3, 2011

(65) Prior Publication Data

US 2012/0227212 A1 Sep. 13, 2012

(30) Foreign Application Priority Data

Aug. 27, 2009 (EP) ..... 09168818

(51) Int. Cl.
*E05F 3/22* (2006.01)

(52) U.S. Cl.
USPC ..... 16/58; 16/68; 16/54

(58) Field of Classification Search
USPC ..... 16/50, 54, 68, 58, 71, 78, 80, 49, 51, 16/318, 319, 280, 281, 310, 316, 317; 188/276, 277, 278, 283, 290, 293
See application file for complete search history.

(56) References Cited

U.S. PATENT DOCUMENTS 2,164,358 A * 7/1939 Stannard ..... 16/54
3,548,443 A * 12/1970 Rassa ..... 16/52
4,100,646 A * 7/1978 Schubeis ..... 16/54
4,148,111 A 4/1979 Lieberman
4,391,020 A * 7/1983 Hsu ..... 16/314
4,413,373 A * 11/1983 Sasaki ..... 16/54
4,573,238 A * 3/1986 Phillips ..... 16/79
4,573,283 A 3/1986 Pippert
4,825,503 A * 5/1989 Shiramasa et al. ..... 16/52
4,829,628 A * 5/1989 Vuksic ..... 16/54
4,995,194 A * 2/1991 Schultze et al. ..... 49/32
5,074,389 A * 12/1991 Slocum ..... 188/277

(Continued)

FOREIGN PATENT DOCUMENTS

AT 393 004 B 7/1991
FR 2 381 948 A1 9/1978
GB 2 156 950 A 10/1985
GB 2 252 790 A 8/1992

*Primary Examiner* — Chuck Mah
(74) *Attorney, Agent, or Firm* — Sughrue Mion, PLLC

(57) ABSTRACT

The present invention relates to a mechanism for closing a hinged member which comprises a resilient element for effecting closure of the hinged member and a hydraulic damper 5. The hydraulic damper 5, comprising a closed cylinder cavity 20 within a cylinder barrel 19, a rotational damper shaft 22 which extends into the cylinder cavity 20, and a piston 21, placed within the cylinder barrel 19 so as to divide the cylinder cavity 20 into a first side 20*a* above the piston 21 and a second side 20*b* below the piston 21. An outer perimeter surface of the piston 21 presents a clearance fit with an inner perimeter surface 27 of the cylinder barrel 19 at 20° C. The cylinder barrel 19 is made of a first material and the piston 21 of a second material which has a higher thermal expansion coefficient than the first material. In this way variations of the viscosity of the hydraulic fluid as a result of pressure fluctuations are compensated for by an increase or a decrease of the cross-section area of the clearance.

23 Claims, 21 Drawing Sheets

(56) References Cited

U.S. PATENT DOCUMENTS

| | | | | |
|---|---|---|---|---|
| 5,414,894 | A * | 5/1995 | Fayngersh | 16/52 |
| 5,419,013 | A * | 5/1995 | Hsiao | 16/319 |
| 6,092,632 | A * | 7/2000 | Popjoy et al. | 188/277 |
| 6,112,368 | A | 9/2000 | Luckett | |
| 6,205,619 | B1 * | 3/2001 | Jang | 16/352 |
| 6,279,693 | B1 * | 8/2001 | Wiebe | 188/129 |
| 6,397,985 | B2 * | 6/2002 | Wiebe | 188/129 |
| 6,412,224 | B1 * | 7/2002 | Feucht et al. | 49/340 |
| 6,854,161 | B2 * | 2/2005 | Lee | 16/50 |
| 7,004,293 | B2 * | 2/2006 | Schurmans | 188/322.17 |
| 2004/0068833 | A1 * | 4/2004 | Sawa | 16/60 |
| 2006/0081428 | A1 * | 4/2006 | Schurmans | 188/276 |
| 2010/0263289 | A1 * | 10/2010 | Sawa | 49/386 |

* cited by examiner

DOOR CLOSING MECHANISM

CROSS REFERENCE TO RELATED APPLICATIONS

This application is a National Stage of International Application No. PCT/EP2010/062539 filed Aug. 27, 2010, claiming priority based on European Patent Application No. 09168818.4 filed Aug. 27, 2009, the contents of all of which are incorporated herein by reference in their entirety.

The present invention relates to a mechanism for closing a hinged member, in particular a door, a gate, a window, etc., which mechanism comprises a resilient element for effecting closure of the hinged member and a hydraulic damper for damping the closing movement of the hinged member. The damper itself comprises a closed cylinder cavity within a cylinder barrel, a piston placed within the cylinder cavity so as to divide it into a first and a second side, and a damper shaft coupled to the piston.

Door or gate closing mechanisms which comprise a combination of a resilient element and a hydraulic damper to effect automatic closure of the hinged closure member without slamming are well-known in the art. The hydraulic components are however delicate and usually badly suited for outdoors use. They are more particularly quite sensitive to temperature variations and are also often subject to leakage problems.

Examples of such door closing mechanisms were disclosed, for example in U.S. Pat. No. 4,825,503 and UK Patent Application GB 2,252,790. These door closing mechanisms comprise a hydraulic rotation damper which includes a rotating piston. These known rotation dampers do however present several drawbacks. Because the rotating piston has a travel of less than 360°, the rotation damper is directly coupled to the actuator output, without any multiplication stages. Since in this application it is important for the damper to be as compact and unobtrusive as possible, the area of the piston is necessarily limited. To achieve the required damping torques, comparatively high hydraulic pressures will thus be required. This makes it more difficult to prevent leaking, in particular through the damping adjustment valve, which is in fluid connection with the high-pressure side of the damper. In particular in outdoor applications, which, to prevent being substantially affected by temperature changes, normally use a hydraulic fluid of low, substantially constant viscosity (i.e. a viscostatic fluid), the low viscosity of the fluid often requires additional measures to prevent leaks. Although only very small amounts of hydraulic fluid may leak out of the damper, it is important to avoid even such small leaks since the damper should be maintenance free for a large number of years.

As an alternative, a different type of hydraulic rotation damper has been disclosed in Austrian Patent AT 393 004 B. This prior art damper comprises a closed cylinder cavity within a cylinder barrel, a damper shaft which extends into the cylinder cavity, and a piston dividing the cylinder cavity into a first side above the piston and a second side below the piston. The piston is in engagement with the damper shaft.

In this prior art damper, when a one-way valve between the two sides of the cavity is closed, hydraulic fluid flows around the piston. The restricted flow around the piston thus dampens the movement of the piston and the rotation of the damper shaft. However, this damping is subject to alteration through environmental influences. Temperature changes will alter the viscosity of the hydraulic fluid. As a result, the damping torque will decrease with an increase in temperature. This will be a drawback in particular in outdoor applications which may be subjected to large temperature variations.

A solution to this problem has been proposed in U.S. Pat. Nos. 4,148,111, 4,573,283 and 6,112,368. The hydraulic dampers disclosed in these patents comprise a fluid passage between the first and the second side of the cylinder cavity so that no fluid has to flow along the piston. The flow of fluid through this fluid passage is restricted by means of an adjustable needle valve. This needle valve comprises a needle provided with a screw thread having a small pitch. By rotating the needle, the gap between the tip of the needle and the valve seat can be adjusted to control the closing speed of the hinged member. In order to compensate for temperature variations and the resulting variations of the viscosity of the hydraulic fluid, the needle of the needle valve is further made of a material which has a higher thermal expansion coefficient than the material of the cylinder barrel. In this way, a change in ambient temperature automatically causes the gap between the tip of the needle valve and the valve seat to increase or decrease. A drawback of such an automatic temperature compensating mechanism is that the tip of the needle valve has to be relatively blunt, i.e. the angle between the surface of the tip and the longitudinal axis of the needle has to relatively large, so that a very small change of the length of the needle, relative to the cylinder barrel, has a sufficiently large effect on the size of the gap between the needle tip and the valve seat. However, in this way, an accurate manual adjustment of the closing speed of the hinged member is no longer possible in view of the fact that the pitch of the screw thread onto the needle is relatively large compared to the relative changes of the needle length.

It is a first object of the present invention to provide a hydraulic damper with an automatic temperature compensating mechanism which does not interfere with any manual closing speed adjustment mechanism.

In accordance with a first aspect of the present invention, there is provided a hydraulic damper as defined by claim 1.

To this object, the hydraulic damper according to the present invention is characterised in that, at least at 20° C., an outer perimeter surface of the piston defines a clearance between an inner perimeter surface of the cylinder barrel to allow hydraulic fluid contained in the cylinder cavity to flow through the clearance between the outer perimeter surface of the piston and the inner perimeter surface of the cylinder barrel between a first side to a second side of the closed cylinder cavity, and in that the cylinder barrel is made of a first material having a first thermal expansion coefficient, and the piston is made of a second material having a second thermal expansion coefficient, the second thermal expansion coefficient being larger than the first thermal expansion coefficient so that the clearance decreases when the temperature of the damper is raised and increases when the temperature of the damper is lowered.

The term "material" as used herein is intended to include a single substance material, such as, a metal or a plastics material or any other suitable homogeneous material. Additionally, the term "material" is also intended to include a composite material, such as, a matrix of one material having at least one further material embedded therein, or an alloy or any other suitable composite material.

It will be appreciated that, in order to provide different thermal expansion coefficients, the cylinder barrel and the piston may comprises more than one material, For example, it may be the case that the cylinder barrel has a body portion made of a first material and is lined with a second different material which together have a combined first thermal expansion of coefficient. Alternatively, the material used for lining of the body portion has the first thermal expansion coefficient.

Similarly, the piston may have an inner core of a first material with an outer covering of a second different material which together have a combined second thermal expansion coefficient. Alternatively, the material used for the covering has the second thermal expansion coefficient.

The thermal expansion differential between the piston and the cylinder barrel thus tends to open the clearance between them at lower temperatures, and close it at higher temperatures, automatically compensating for the thermal variation in viscosity of the hydraulic fluid. It has been found that the difference between the thermal expansions of the piston and the cylinder barrel may be sufficiently large, relative to the size of the clearance between the piston and the wall of the cylinder cavity, to compensate for the corresponding viscosity variations. In contrast to the prior art closing mechanisms, wherein the needle of the needle valve should be made substantially longer to achieve a bigger effect on the flow rate through the restricted flow passage, the piston nor the cylinder barrel should be made larger in the closing mechanism of the present invention. Moreover, if a manual closing speed adjusting mechanism is provided, the automatic temperature compensating mechanism doesn't interfere in any way with this manual mechanism.

Advantageously, the difference between the first and second thermal expansion coefficients may be at least $1.5\cdot\times10^{-5}$ $K^{-1}$.

In accordance with a further aspect of the present invention, there is provided a mechanism for closing a hinged member with respect to a fixed frame as defined by claim 14.

It is a further object of the present invention to provide a closing mechanism with a rotation damper.

For this purpose, the piston of the hydraulic damper of the closing mechanism according to the invention may comprise at least one helical thread in engagement with a corresponding thread on either the cylinder barrel or the damper shaft, and a rotation-preventing member in engagement with a guide on the other one of the damper shaft or cylinder barrel, so that a rotational motion of the shaft with respect to the cylinder barrel results in a translational motion of the piston along the longitudinal axis.

It will readily be appreciated that the piston may have an external thread formed on its outer surface that engages an internal thread formed in an internal surface the cylinder barrel. Alternatively, the damper shaft may have an external thread formed on its outer surface that engages with an internal thread formed in an internal surface of the piston. In accordance with the present invention, it is the relative rotation between the damper shaft/piston combination and the cylinder barrel that translates into translational movement of the piston within the cylinder barrel.

Advantageously, the piston may at least be partially in a synthetic material, i.e. the second material may be a synthetic material, which allows a precise tailoring of its thermal expansion with respect of that of the cylinder barrel, and simultaneously offers low friction, in particular against a metallic inner perimeter surface of the cylinder barrel. Even more advantageously, the synthetic material may be polyoxymethylene (POM), which besides low friction against metal and suitable thermal expansion characteristics, also presents a high resiliency.

Advantageously, the clearance at 20° C. between the piston and the inner wall of the cylinder cavity is so small, and the difference between the thermal expansion coefficients of the first and second materials so large that the outer perimeter surface of the piston presents a press fit with an inner perimeter surface of the cylinder barrel when the temperature of the damper rises above a predetermined temperature which is higher than 25° C., preferably higher than 30° C. but lower than 50° C., preferably lower than 45° C. The friction between piston and barrel will assist the compensation of the lower hydraulic fluid viscosity above this predetermined temperature.

Preferably, the clearance at 20° C. between the piston and the cylinder barrel is so small, and the difference between the thermal expansion coefficients of the first and second materials so large that the minimum cross-sectional size of the clearance, measured in a plane perpendicular to the longitudinal axis of the cylinder cavity increases with at least 10%, preferably with at least 20% and more preferably with at least 30% when the temperature of the damper is lowered from 20° C. to 10° C.

Advantageously, a hydraulic damper according to an embodiment of the invention may further comprise a restricted fluid passage between the first and second sides of the cylinder cavity. This provides a separate fluid path between the two sides of the cylinder cavity besides the clearance between piston and cylinder barrel, allowing more consistent damping characteristics. Even more advantageously, the restricted passage may have an adjustable flow restrictor, so that the damping torque can be adjusted. This adjustable flow restrictor can be designed to enable an accurate control of the damping torque, and this completely independent from the automatic temperature compensation which is achieved by the control of the clearance between the piston and the wall of the cylinder cavity.

In a particular embodiment of the present invention, the damper may further comprise a one-way valve allowing fluid flow from the first side to the second side of the cylinder cavity. This hydraulic damper will therefore present unidirectional damping characteristics.

Advantageously, the narrowest cross-section of the restricted fluid passage is not larger than at most five times, preferably at most three times a minimum cross-sectional area of the clearance between the piston and the cylinder barrel, measured in a plane perpendicular to the longitudinal axis of the cylinder cavity at 20° C.

Advantageously, within the restricted passage, the damper may comprise a flow restrictor, in particular in the form of a needle valve, adjustable through an orifice in the cylinder barrel, wherein the second side of the cylinder cavity and the orifice are at opposite sides of the flow restrictor.

Due to the presence of the one-way valve which allows flow of fluid from the first side of the cylinder cavity to the second side thereof, the damping force of the damper is smaller when the piston is moved towards the first side of the cylinder cavity than when it is moved towards the second side thereof. Consequently, under normal conditions of use, a much higher pressure will be produced in the second cylinder cavity side when the piston is moved towards this second side than in the first cylinder cavity side when the piston is moved towards this first side. As the orifice and the second, high-pressure side of the cylinder cavity are at opposite sides of the flow restrictor, this adjustment orifice will be isolated from the high pressure in the second side of the cylinder cavity, substantially reducing the risk of leaks.

Advantageously, the top of the cylinder barrel may present an opening through which the damper shaft extends into the first side of the cylinder cavity, and the bottom may be closed. Since the opening through which the damper shaft extends into the cylinder cavity leads only to the first, low-pressure side of the cylinder cavity, leaks through this opening, around the damper shaft, are also suppressed. In a vertical orientation of the damper, even gravity leaks are prevented.

Even more advantageously, the orifice for the adjustment of the flow restrictor may also open towards the top of the cylinder barrel, so that, in the abovementioned vertical orientation of the damper, any leaks, in particular also gravity leaks, will be prevented.

Advantageously, in a hydraulic rotation damper according to the invention, the piston may present a cavity, open towards the top of the cylinder barrel for receiving the damper shaft, but substantially closed towards the bottom of the cylinder barrel, the damper shaft being screwed in the cavity and the cavity forms part of the first side of the cylinder cavity and is in substantially unrestricted fluid communication with the remaining part of the first side of the cylinder cavity. Since the two sides of the cylinder will thus not be connected by the interface between piston and damper shaft, no pressure loss will occur there. Advantageously, the piston cavity may be in substantially unrestricted fluid communication with the remaining part of the first side of the cylinder cavity through a duct in the damper shaft. Also advantageously, the one-way valve may be placed in the piston, between the second side of the cylinder cavity and the piston cavity. Both these options have the advantage of increased compactness of the rotation damper and of making the construction of the damper less complicated.

It is a further object of the present invention to provide a hydraulic damper which is protected against too high stresses in the damper or in the actuator which comprises the damper. For this purpose, the damper of the invention may advantageously be provided with a relief or safety valve allowing fluid flow from the second side to the first side of the cylinder cavity, set to open when an overpressure in the second side exceeds a predetermined threshold, and close again once the overpressure falls back under the same, or a lower threshold. The overpressure required to open the relief valve is higher than the pressure which is required to open the one-way valve to allow fluid flow from the first to the second side since the relief valve should not open under normal conditions of use but only when the pressures would become too high whilst the one-way valve should open immediately when the piston is moved towards the first side of the cylinder cavity so that this movement is damped as little as possible. Just like the one-way valve, the relief or safety valve may also be placed in the piston between the second side of the cylinder cavity and the piston cavity.

It is a further object of the present invention to release the damping torque near the end of travel of the damper.

To this object, the damper, in particular the restricted fluid passage, may comprise a bypass from a first, lower point of the cylinder cavity to a second, higher point of the cylinder cavity, around the flow restrictor.

The terms "top", "bottom", "above", "below", "upwards", and "downwards", as used in this description, should be understood as relating to the normal orientation of these devices in use. Of course, during their production, distribution, and sale, the devices may be held in a different orientation.

Several preferred embodiments of the invention will be described illustratively, but not restrictively, with reference to the accompanying figures, in which:

FIG. 1*a* is a longitudinal section of an embodiment of a rotation damper of a door or gate closing mechanism according to the invention;

FIGS. 1*b* and 1*c* are transversal sections of the rotation damper of FIG. 1*a*, along, respectively, lines B-B, and C-C;

FIG. 2 is a perspective view, with partial cutaways, of the rotation damper of FIG. 1;

FIGS. 3*a* to *c* are further longitudinal sections of the rotation damper of FIG. 1*a*, with the damper shaft in a clockwise rotation and the piston in an upwards motion;

FIG. 3*d* is a transversal section of the rotation damper of FIG. 3*b* along line D-D;

FIGS. 4*a* to *c* are longitudinal sections of the rotation damper of FIG. 1*a*, with the damper shaft in a counter-clockwise rotation and the piston in a downwards motion;

FIG. 5*a* is a perspective view of an embodiment of a linear door or gate closing mechanism according to the invention, which comprises the rotation damper illustrated in the previous figures;

FIG. 5*b* is an exploded perspective view of the closing mechanism of FIG. 5*a;*

Figures 5A, 5B:
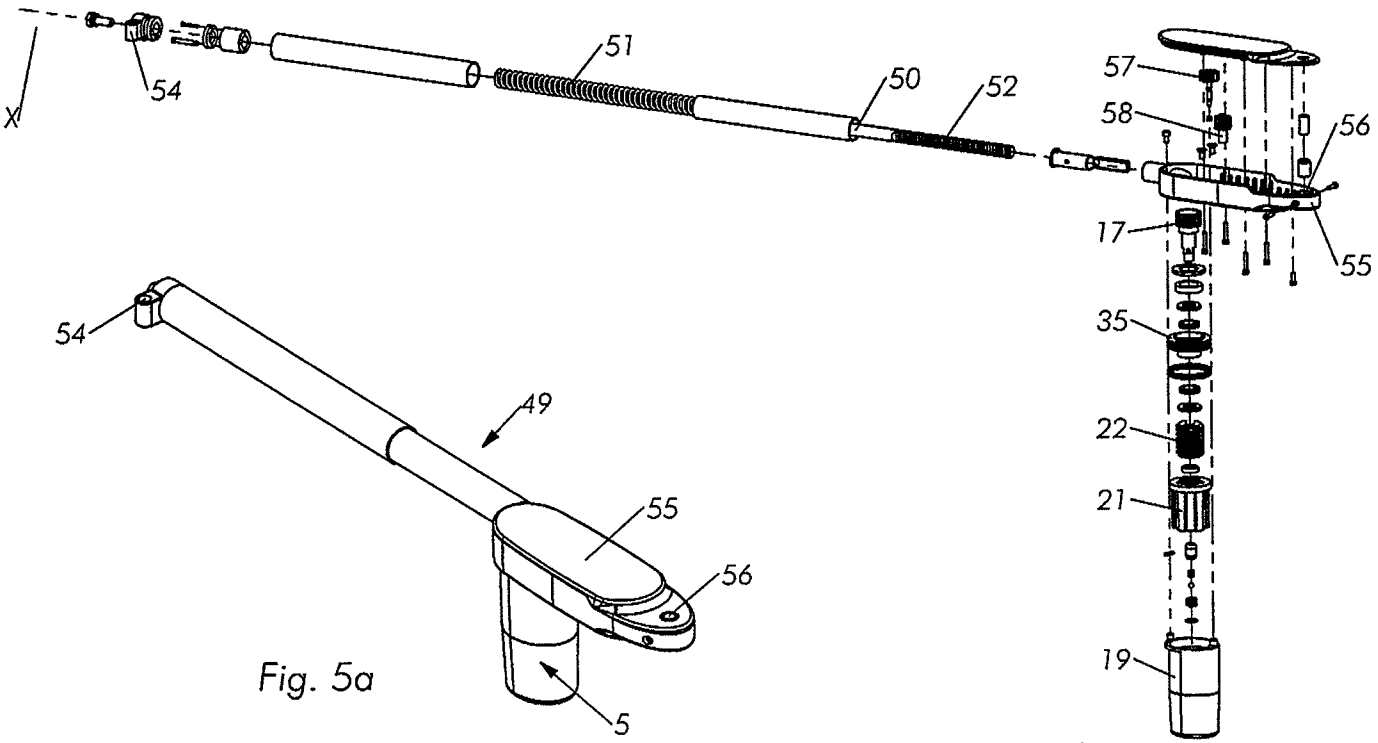
Figure 10B:
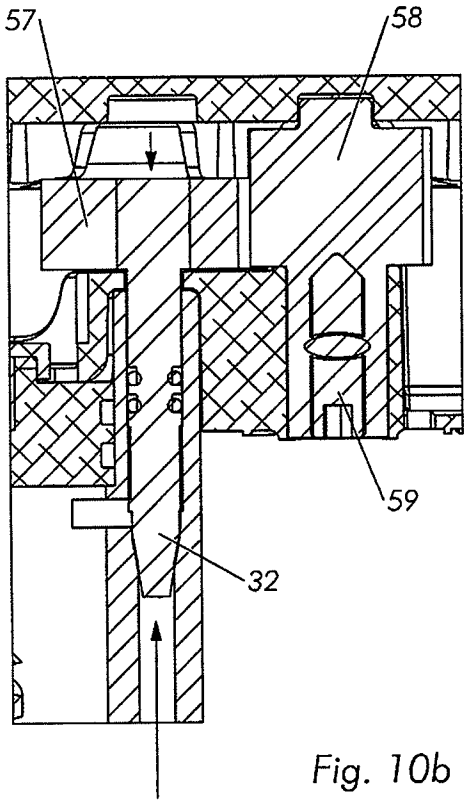
Figure 10A:
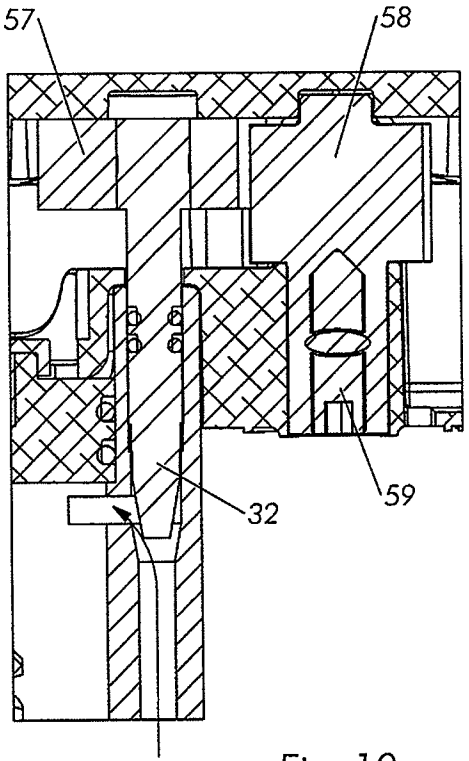

FIGS. 10*a* and 10*b* are detail cut views of the closing mechanism of FIGS. 5*a* and 5*b;*

Figure 11A:
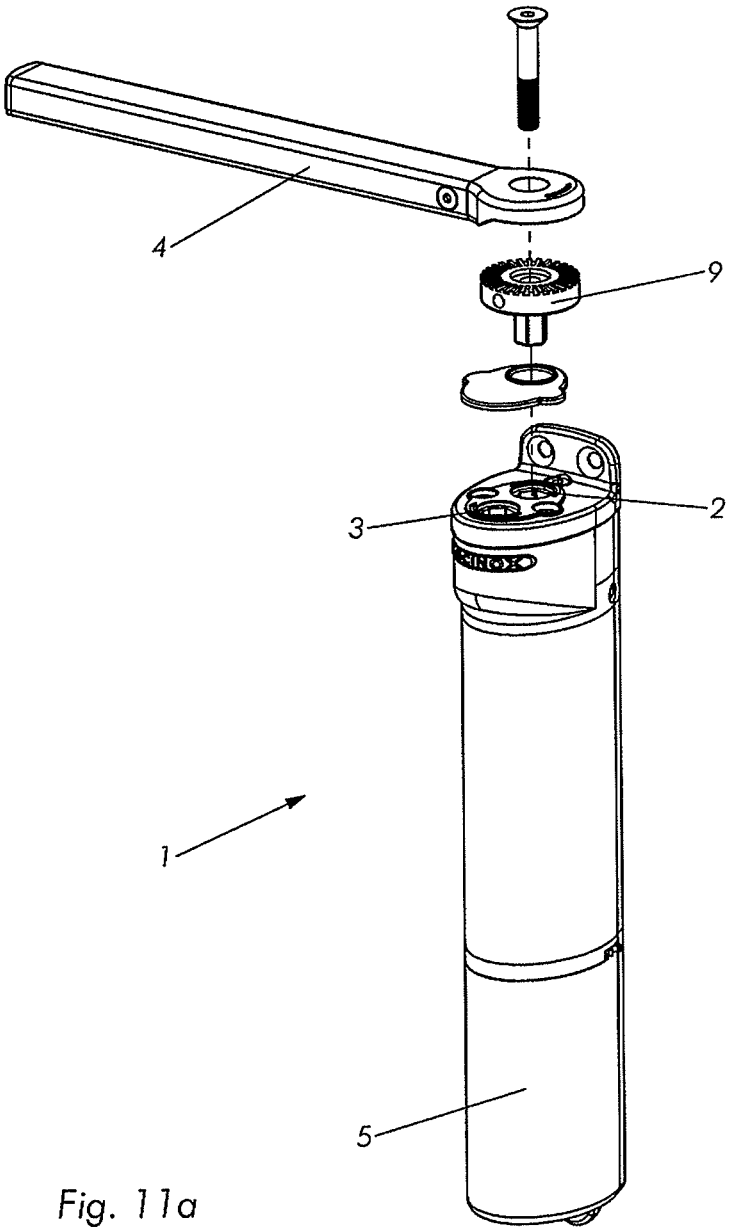
Figure 11B:
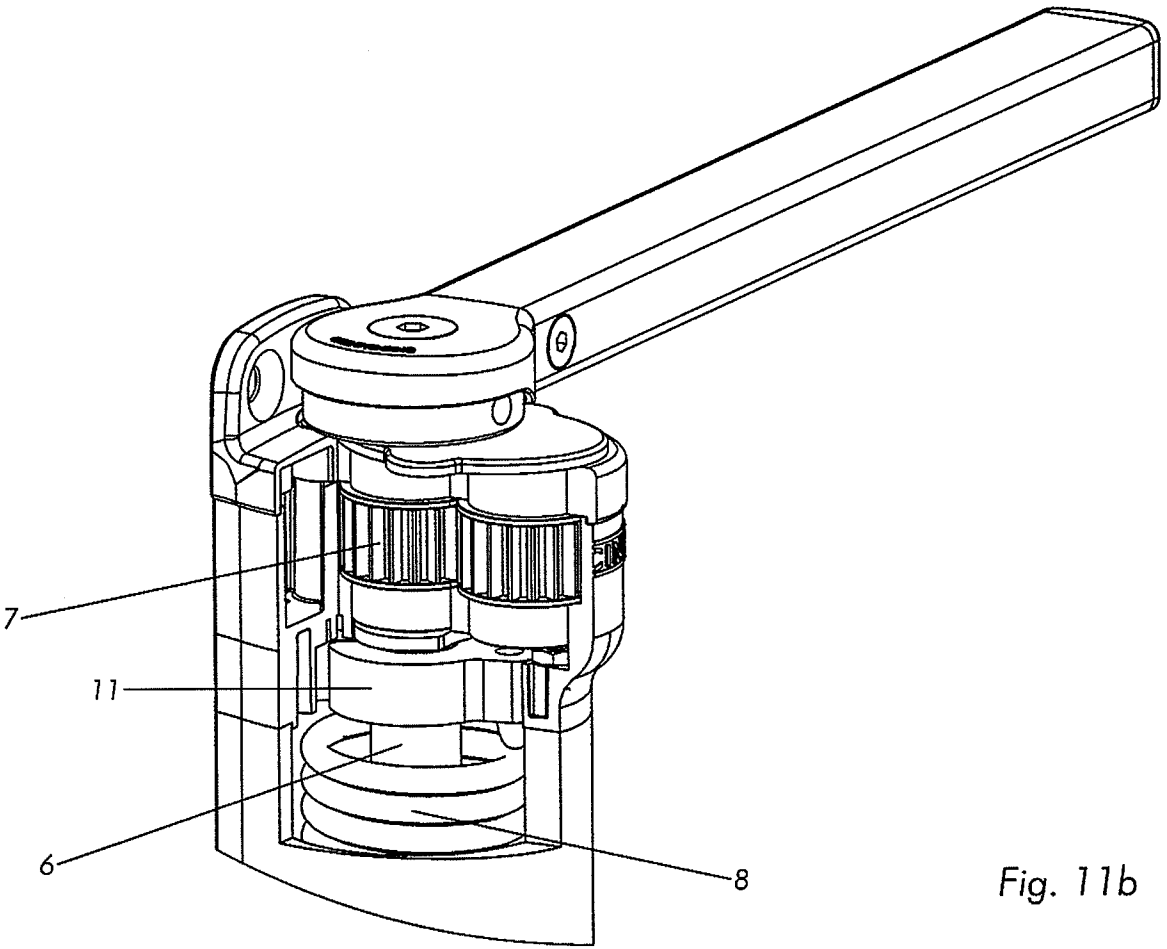

FIG. 11*a* is a perspective view of an embodiment of a rotational door or gate closing mechanism according to the invention, which comprises the rotation damper illustrated in FIGS. 1 to 4;

FIG. 11*b* is a cut detail view of the closing mechanism of FIG. 11*a;*

Figure 12A:
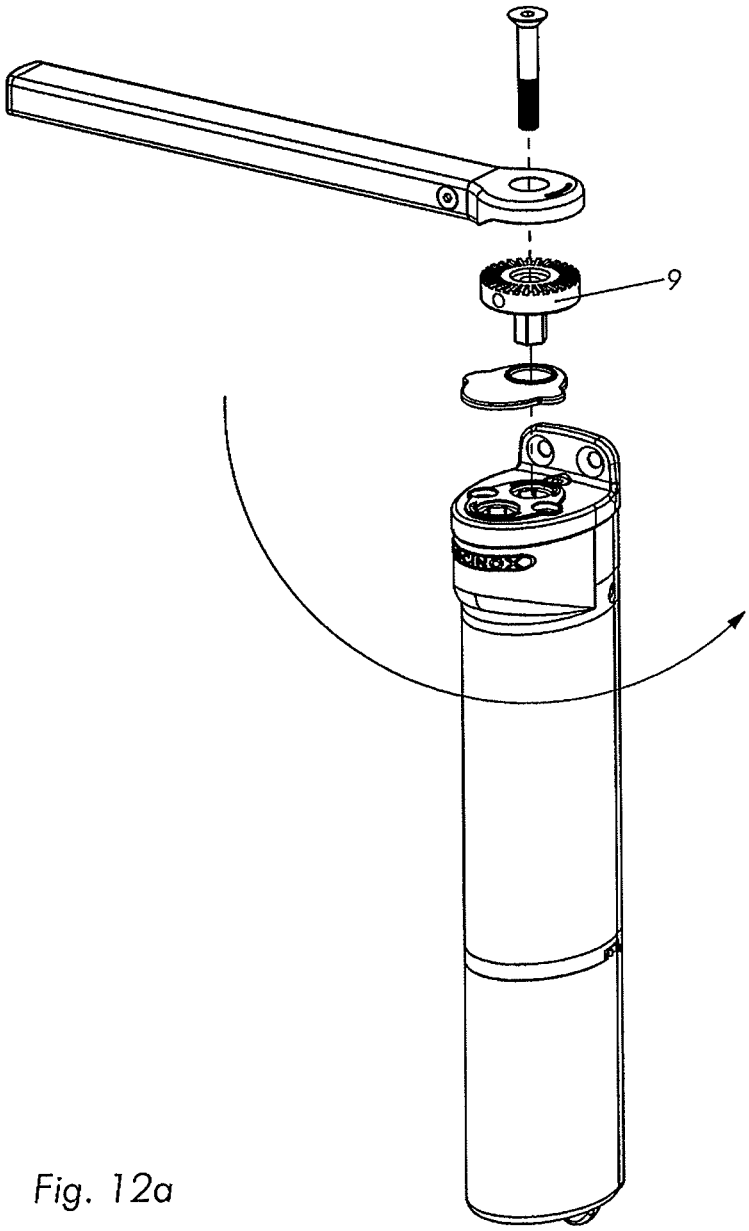
Figure 12B:
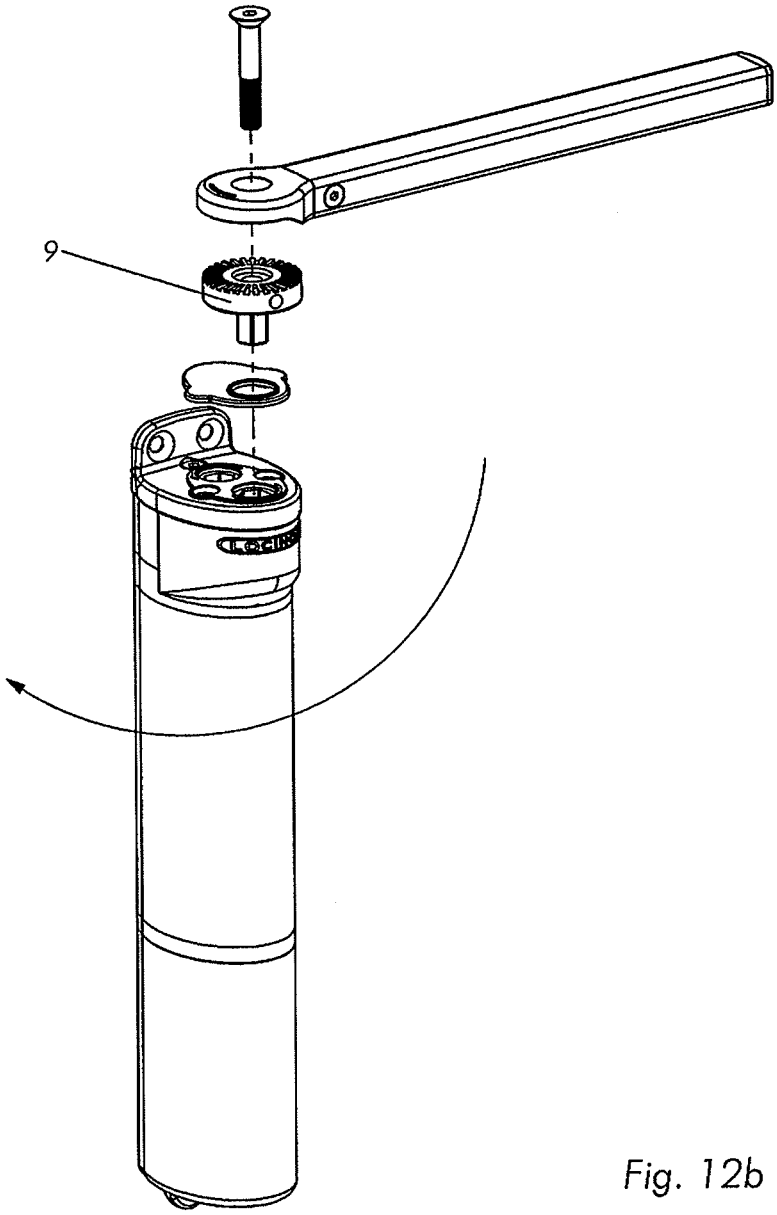

FIGS. 12*a* and 12*b* show two alternative arrangements of the closing mechanism of FIG. 11*a;*

Figure 12C:
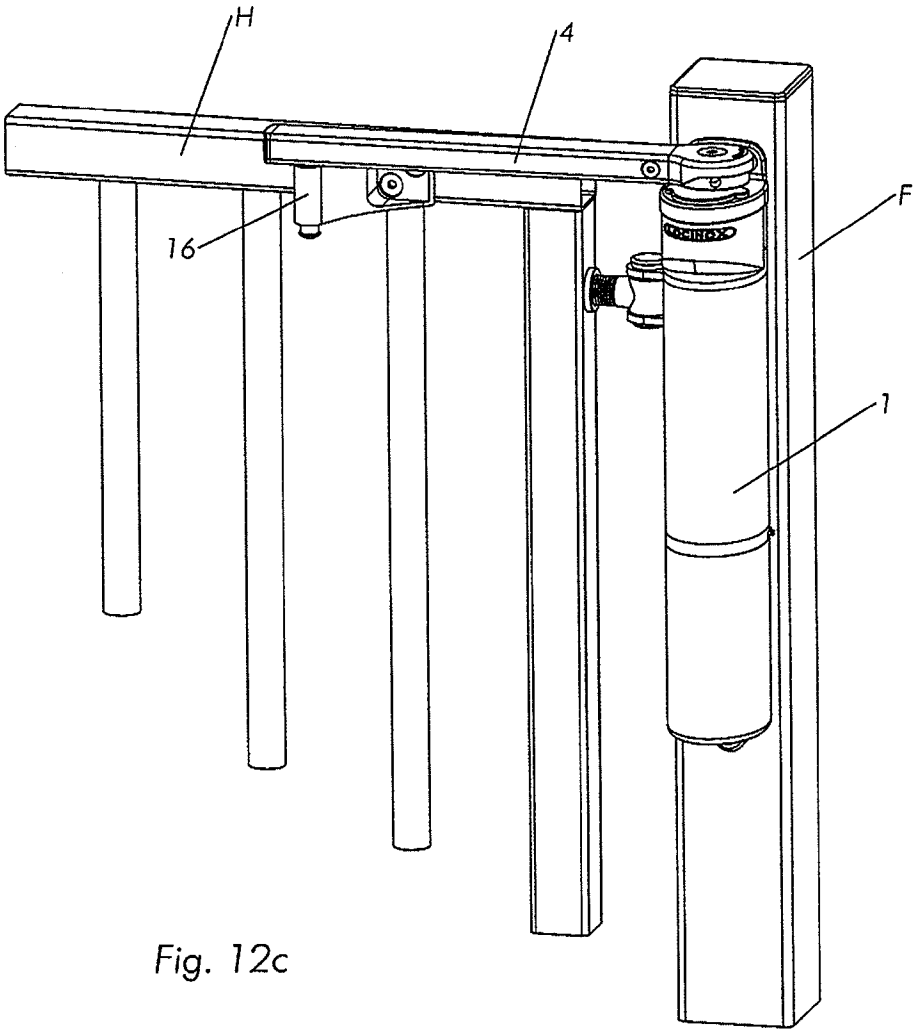
Figure 12D:
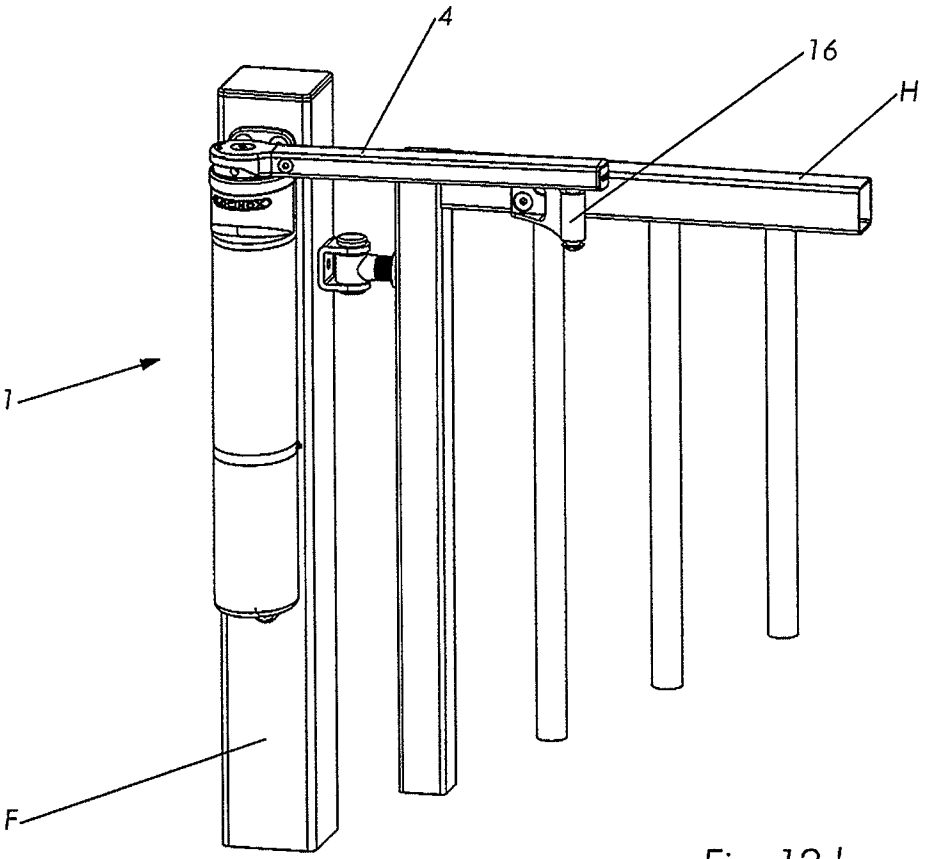
Figure 13:
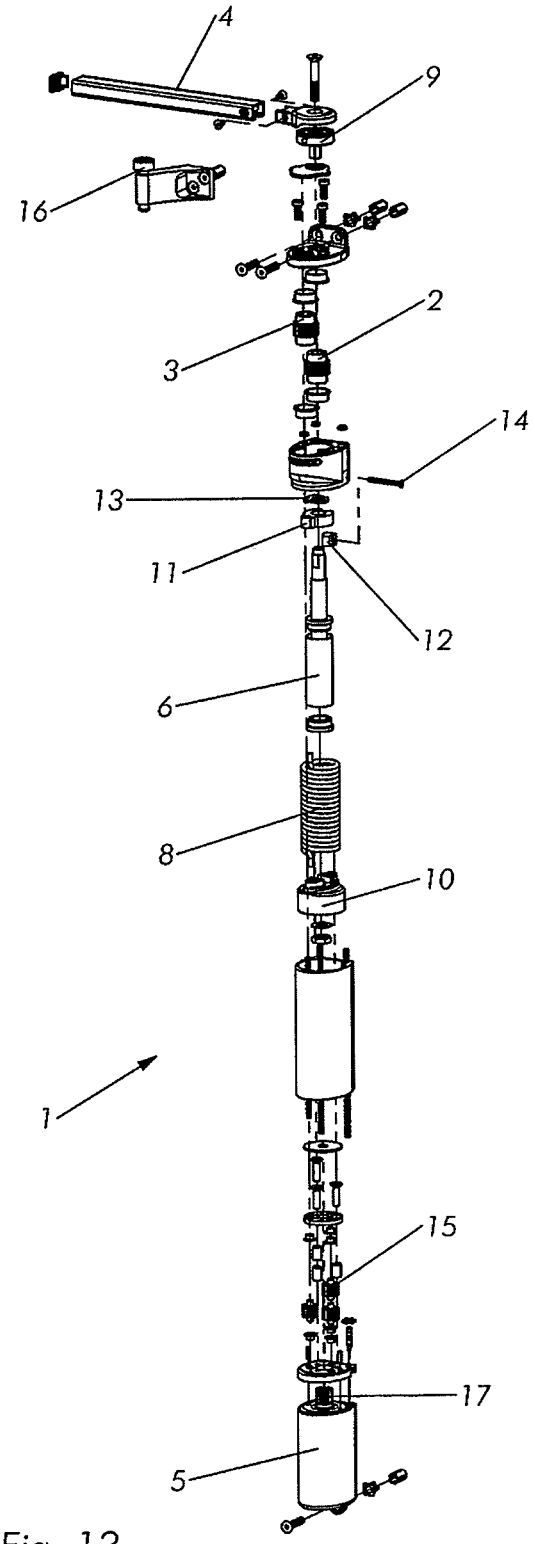
Figure 13A:
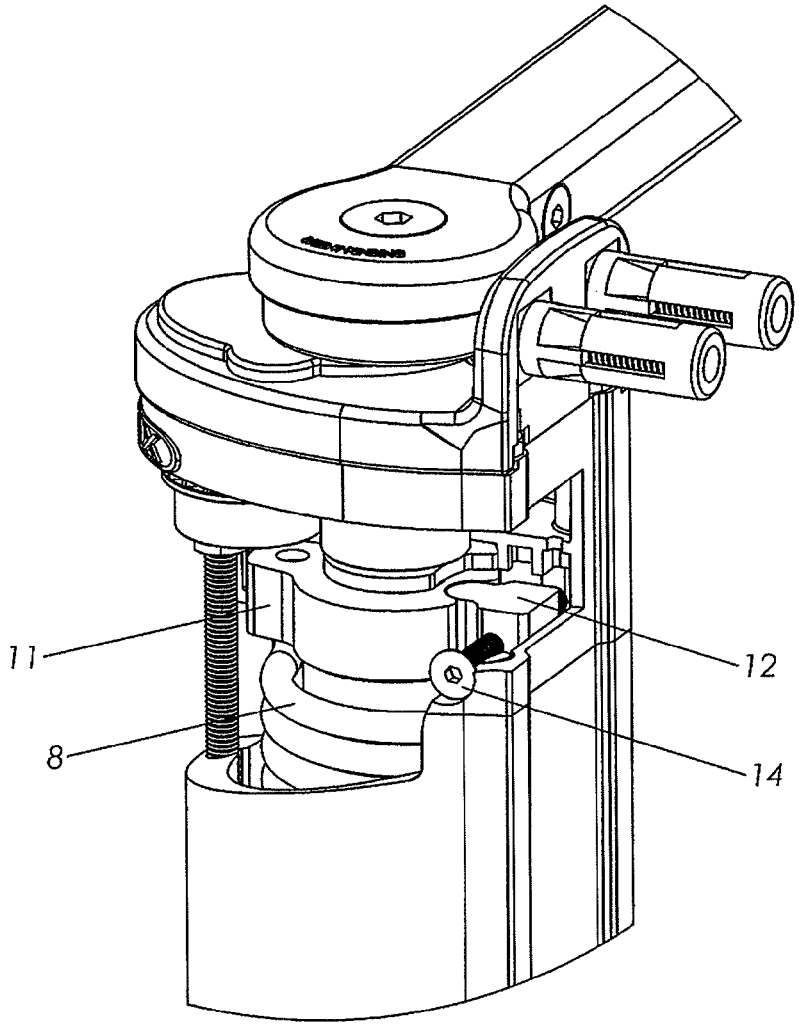
Figure 13B:
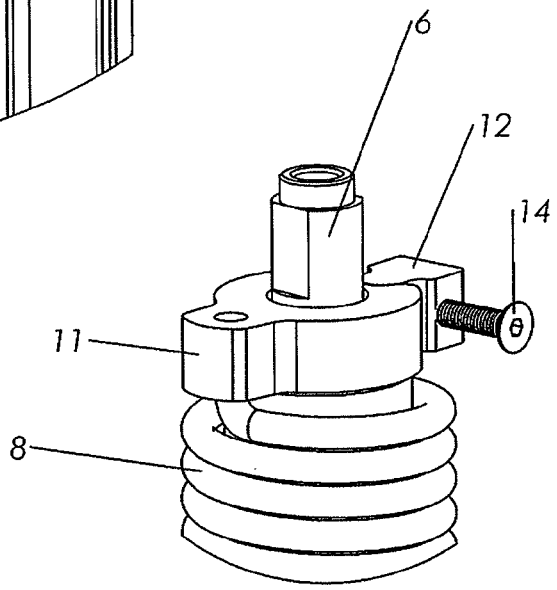
Figure 13C:
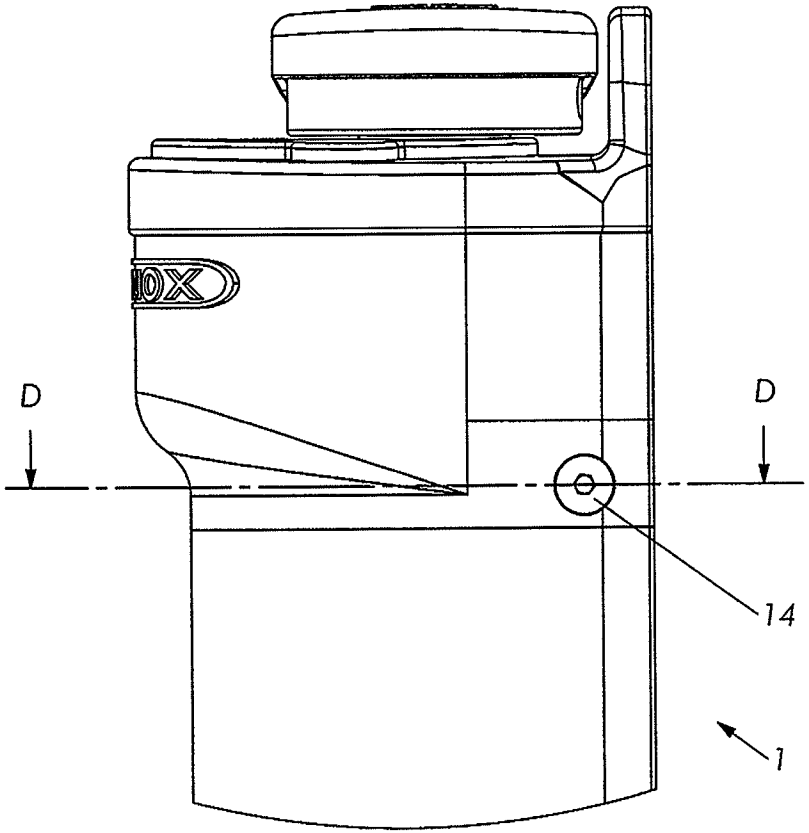
Figures 13D, 13E:
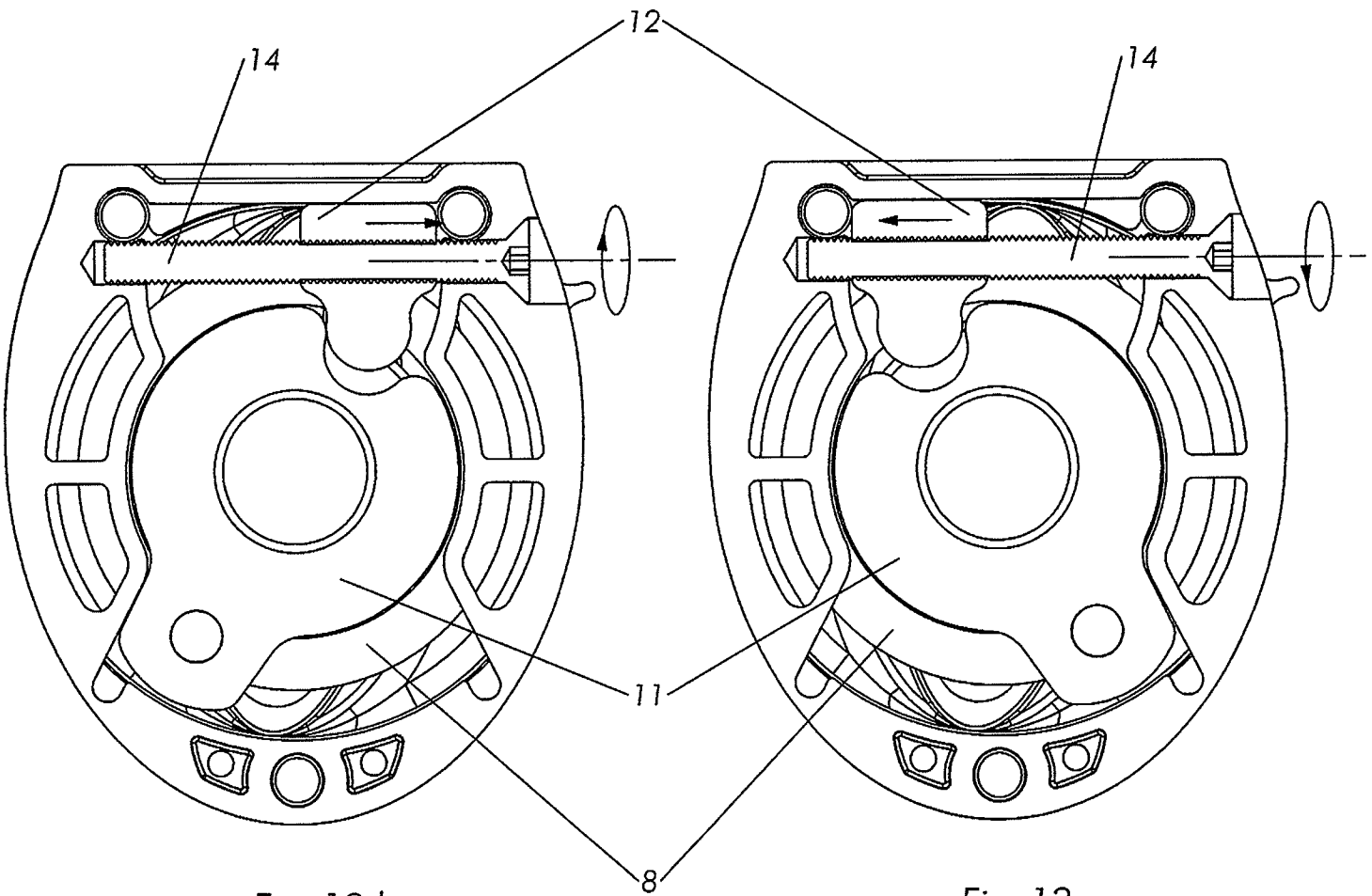

FIGS. 12*c* and 12*d* respectively show each one of the abovementioned two alternative arrangements of the closing mechanism of FIG. 11*a* applied respectively to a left and a right turning gate;

FIG. 13 is an exploded view of the door closing mechanism of FIG. 11*a;*

Figure 15B:
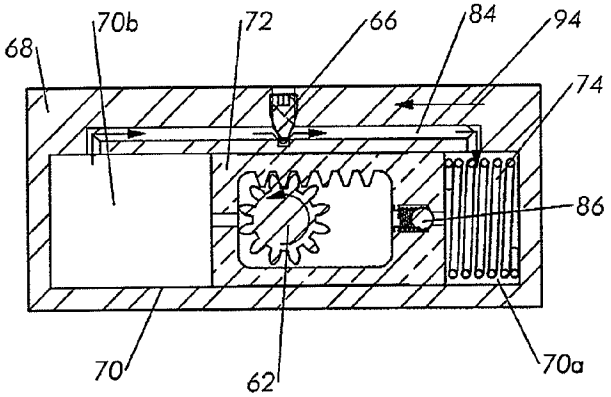
Figure 15A:
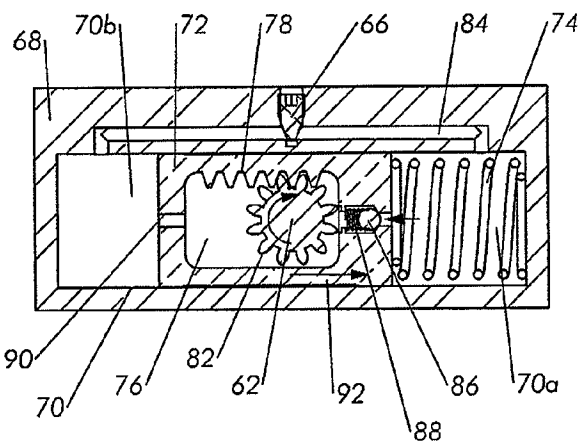
Figure 14:
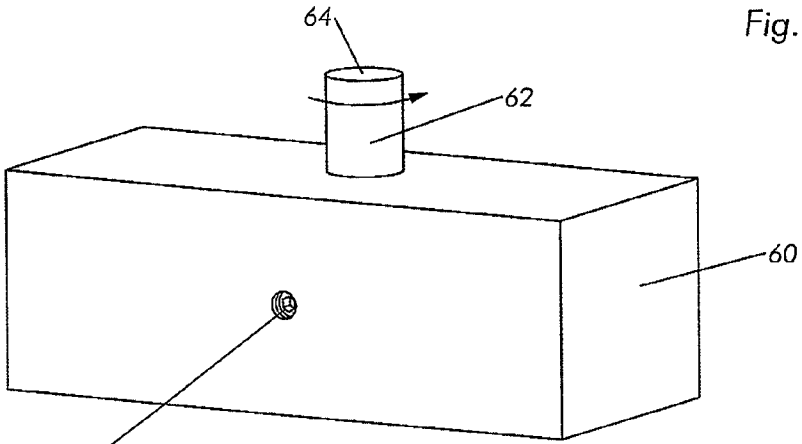

FIGS. 13*a* to *e* are detail views showing the mechanism for adjusting the tension of the resilient element of the closing mechanism illustrated in FIG. 13;

FIG. 14 is a partial perspective view of a second embodiment of a closing mechanism according to the invention;

FIG. 15*a* is a sectioned view of the closing mechanism of FIG. 14 during an opening motion; and FIG. 15*b* is a sectioned view of the closing mechanism of FIG. 14 during a closing motion.

The present invention relates to a mechanism C for closing a hinged member H. The hinged member H may be a door, a gate or a window, in particular an outdoor door or gate which is subjected to strongly varying temperatures. The closing mechanism C comprises a resilient element for effecting closure of the hinged member and a hydraulic damper for damping the closing movement of the hinged member under the action of the resilient element. A first embodiment of the closing mechanism, which comprises a push rod pivotally connected to the hinged member, is illustrated in FIGS. 5 to 8. A second embodiment, which comprises a rotating arm slideably engaging the hinged member, is illustrated in FIGS. 11 to 13. Both closing mechanisms comprise a same hydraulic damper which is arranged for compensating for the viscosity changes of the hydraulic fluid as a result of the varying ambient (outdoor) temperatures.

Figure 1B:
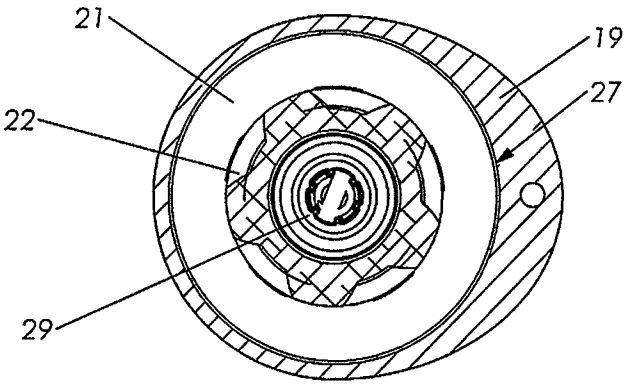
Figure 1C:
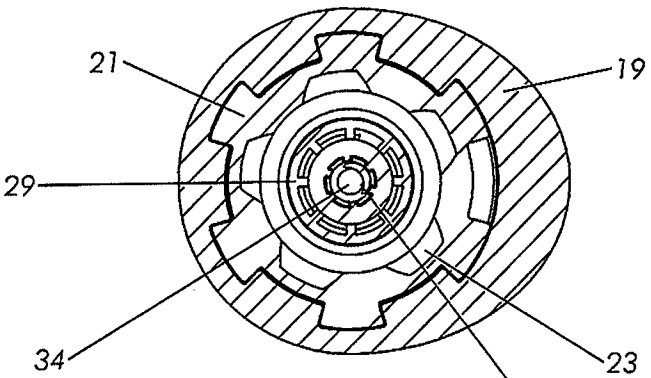

A first embodiment of such a hydraulic damper 5, in particular a rotation damper, is illustrated in FIG. 1. It comprises a cup-shaped cylinder barrel 19 which is completely closed at the bottom but open at its top. The open top of the cup-shaped cylinder barrel 19 is closed by means of a lid 35 to form a closed cylinder cavity 20. This cylinder cavity 20 is divided by a piston 21 into a first side 20*a* and a second side 20*b*. A damper shaft 22, which in this embodiment is topped by a pinion 17, is connected to the piston 21 and extends through an opening in the lid 35 out of the cylinder cavity 20 forming a sliding cylindrical joint. This sliding cylindrical joint is sealed off by means of a shaft seal (O-ring) applied around the damper shaft 22 (not shown).

Figure 1A:
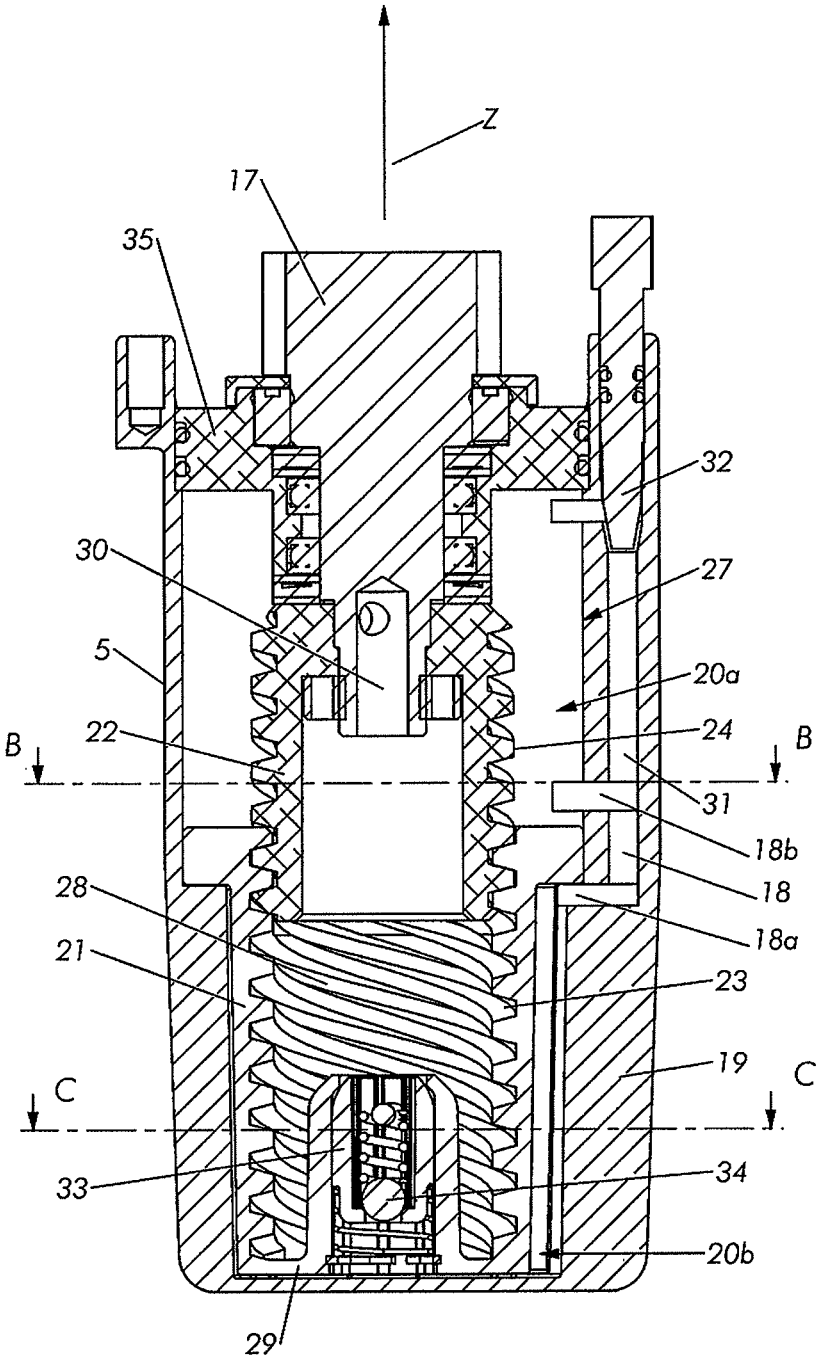
Figure 2:
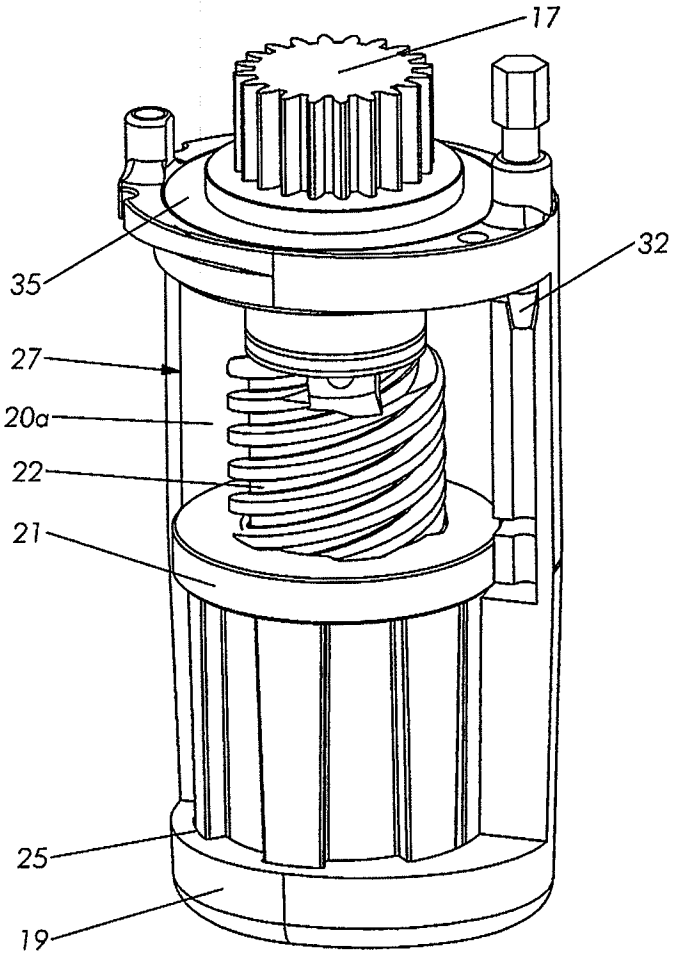

The piston 21 has a piston cavity 28 which has an inner helical thread 23 in engagement with a corresponding outer helical thread 24 on the damper shaft 22. The helical threads are multiple threads comprising in particular four threads. In this way, the pitch of the threads 23, 24 may be increased, in particular above 10 mm, for example to about 30 mm. The pitch of the threads 23, 24 is however so small with respect to the length of the threaded segment, that more than 1 rotation, preferably more than 1.5 rotation of the damper shaft 22 is required to move the piston 21 from its uppermost to its lowermost position. On its outer side, the piston 21 has a rotation-preventing member in the form of protrusions in engagement with a guide in the form of corresponding longitudinal grooves 25 on part of the inner surface of the cylinder barrel 19 (FIG. 2). By this means, a rotational movement of the damper shaft 22 is converted into a translational movement of the piston 21 within the cylinder barrel 19. A clockwise rotation of the damper shaft 22 will thus displace the piston 21 upwards, whereas a counter-clockwise rotation of the damper shaft will displace the piston 21 downwards. Alternative means are however at the reach of the skilled person. For instance, the helical threads could be instead on the piston 21 and the cylinder barrel 19, and the rotation-preventing member placed between the piston 21 and the damper shaft 22. Alternative rotation-preventing members, such as, for example, simple pin-and-groove systems, could also be considered according to the particular needs of the user.

The piston 21 further comprises, above the rotation-preventing member, an outer perimeter surface that defines a clearance (not shown) with an inner perimeter surface 27 of the cylinder barrel 19 at 20° C. This clearance restricts flow of the hydraulic fluid around the piston 21 between the first and second sides 20*a*, 20*b* of the cylinder cavity 20 producing a resulting loss in pressure between the first and second sides 20*a*, 20*b*. It in particular also enables a less viscous hydraulic fluid to be used which offers the advantage that it is easier to select a hydraulic fluid, the viscosity of which is less temperature dependent and thus more suitable for outdoor use. The hydraulic fluid is preferably a substantially viscostatic fluid.

To further reduce the influence of temperature variations in the damping torque of the damper 5, the piston 21 of the illustrated embodiment is in a synthetic material presenting a lower linear thermal expansion coefficient than the material (metal) of the cylinder barrel 19. The clearance between piston 21 and barrel 19 will thus decrease with increasing temperatures, compensating for the decrease in viscosity of the hydraulic fluid. From a certain temperature onwards, for example from a temperature which is higher 25° C., preferably higher than 30° C., but lower than 50° C., preferably lower than 45° C., the thermal expansion differential between piston 21 and barrel 19 may turn the clearance fit into a press fit. The friction between piston 21 and barrel 19 then further compensates for the higher fluidity of the hydraulic fluid.

In a test example of a hydraulic rotation damper 5 according to this embodiment of the invention, the cylinder barrel 19 has an internal diameter of 55 mm at 20° C., whereas the piston 21 has an external diameter of 54.97 mm. The cylinder barrel 19 is made of aluminium, whereas the piston is injection-moulded from a polyoxymethylene (POM) sold under the brand Hostaform® C9021. While the theoretical linear thermal expansion coefficient of aluminium is $2.3\times10^{-5}$ $K^{-1}$ and that of Hostaform® C9021 is $9\cdot\times10^{-5}\cdot K^{-1}$, our measurements at −25° C., 20° C., and 60° C. have resulted in a real average thermal expansion coefficient $\alpha_{real}$ of $3.23\times10^{-5}$ $K^{-1}$ for the inner diameter of the aluminium cylinder barrel 19, and $6.215\cdot\times10^{-5}$ $K^{-1}$ for the Hostaform® piston 21. This is explained by the influence of the shapes of these parts, as well as, in the case of the piston 21, by the anisotropic properties of this injection-moulded part. Since, during the injection-moulding of the piston 21 the material flows in a significantly longitudinal direction, the piston 21 presents significantly different properties in that direction and in a perpendicular plane.

Table 1 shows the different diameters of the barrel 19 and piston 21 at −25° C., 20° C. and 60° C., as well as their resulting real average thermal expansion coefficients $\alpha_{real}$. The thermal expansion coefficient is calculated on the basis of the formula:

$$Ø_{20+\Delta T}=Ø_{20}\times[1+(\alpha\times\Delta T)].$$

TABLE 1

Comparative thermal expansion of cylinder 21 and barrel 19

| | $Ø_{-25}$ at −25° C. [mm] | $Ø_{20}$ at 20° C. [mm] | $Ø_{60}$ at 60° C. [mm] | $\alpha_{real}$ [$10^{-5}$ $K^{-1}$] |
|---|---|---|---|---|
| Barrel | 54.92 | 55 | 55.07 | 3.23 |
| Piston | 54.82 | 54.97 | 55.11 | 6.215 |

In this test example, the hydraulic fluid used has been a hydraulic fluid sold under the brand Dow Corning® 200(R) 100 cSt. Table 2 presents the clearance cross-section areas (in a plane perpendicular to the longitudinal axis of the cylinder cavity) between barrel 19 and piston 21 besides the viscosity values for this fluid at various temperatures. The clearance cross-section areas at 10 and 30° C. have been calculated based on the above mentioned formula and the average thermal expansion coefficients $\alpha_{real}$. They are respectively about 53% larger and about 53% smaller than the clearance cross-section area at 20° C. This percentage can be adjusted by choosing another material, having another thermal expansion coefficient, for the cylinder barrel and/or for the piston, or also by increasing or reducing the clearance between the piston and the cylinder barrel.

TABLE 2

Evolution of clearance area and viscosity with temperature

| | Clearance area [$mm^2$] | Viscosity [cSt] |
|---|---|---|
| −25° C. | 8.619 | 400 |
| 10° C. | 3.971 | |
| 20° C. | 2.591 | 100 |
| 30° C. | 1.210 | |
| 60° C. | −3.461 | 50 |

As can be seen from Table 2, at low temperatures the increase of the hydraulic fluid's viscosity is compensated by an almost proportional increase in the area through which the hydraulic fluid may flow around the piston 21. On the other hand, the "negative" clearance at 60° C. indicates that at that temperature the piston 21 is in a press fit with the barrel 19. The present test example transitions from a clearance fit to a press fit at around 37° C. From that temperature onwards, the lower viscosity of the fluid is also compensated by an increasing friction between piston 21 and barrel 19. The elasticity and high resistance against constant stresses shown by synthetic materials, and in particular by the POM used in the example ensures that, even after longer periods in a press fit with the barrel 19, the piston 21 will recover its original shape after cooling.

The cavity 28 of the piston 21 is closed at its lower end to form the piston bottom 29 dividing the cylinder cavity 20 into a first side 20*a* and a second side 20*b*. This cavity 28 is connected by a substantially unrestricted fluid duct 30 in the damper shaft 22 to the remaining part of the first side 20*a* of the cylinder cavity 20 so that pressure in the cavity 28 is substantially the same as the pressure in the remaining part of the first side 20*a* of the cylinder cavity 20.

The first and second sides 20*a*, 20*b* of the cylinder cavity 20 are connected by a fluid passage 31, restricted by a needle valve 32, accessible through an orifice opening at the top of the cylinder barrel 19 for adjusting its resistance to hydraulic fluid flow between the first and second sides 20*a*, 20*b*, and therefore the damping characteristics of the rotation damper 5. The needle of the needle valve 32 is sealed by means of a shaft seal (O-ring) in the orifice opening. In the illustrated embodiment, the fluid passage 31 has, at its narrowest point, a diameter of 3 mm, and thus a circular cross-section area of 7.07 $mm^2$, which is less than three times the cross-sectional clearance area between the piston 21 and the cylinder barrel 19. In this way, even with a fully open needle valve 32, the hydraulic fluid flow around the piston 21 remains a significant fraction of the hydraulic fluid flow through the fluid passage 31, and a good compromise between damping adjustability and the automatic compensation of viscosity changes due to temperature variations is achieved at all usual ambient temperatures.

The illustrated rotation damper 5 is substantially unidirectional, opposing a substantially higher torque resistance to a counter-clockwise rotation of the damper shaft 22 (lowering of the piston) than to a clockwise rotation of the same damper shaft 22 (raising of the piston) at the same speed. For this purpose, the rotation damper 5 comprises a further fluid duct connecting the first and second sides 20*a* and 20*b* of the cylinder cavity 20. This further duct is not provided with a needle valve but instead with a one-way valve 33 allowing hydraulic fluid flow from the first side 20*a* to the second side 20*b* of the cylinder cavity 20. Therefore, when the damper shaft 22 rotates in a counter-clockwise direction in respect to the axis Z, and the piston 21 travels downwards, the one-way valve will stay closed, and the rotation damper 5 will oppose a significantly higher torque against this movement than when the damper shaft 22 rotates in a clockwise direction and the piston 21 travels upwards, in which case the one-way valve 33 will open, letting the hydraulic fluid flow from the first side 20*a* to the second side 20*b*.

In the illustrated embodiment, the rotation damper 5 comprises, within the body of the one-way valve 33, yet another duct connecting the first and second sides 20*a* and 20*b* of the cylinder cavity. This duct comprises a relief valve 34 allowing flow of hydraulic fluid from the second side 20*b* to the first side 20*a* only when the pressure inside the second side 20*b* becomes too high, i.e. when it exceeds a safety threshold level. This valve is thus a safety valve which prevents damage to the mechanism, for example when a person or the wind exerts an extra force onto a door or gate connected to this rotation damper 5 to close it. In this case, opening of the valve allows a higher closing speed (forced closing of the hinged member) and thus prevents high stresses in the rotation actuator and in the arm linking it to the hinged member. In the illustrated embodiment, both the one-way valve 33 and the relief or safety valve 34 are provided in ducts in the piston bottom 29, between the second side 20*b* and the piston cavity 28. However, alternative configurations and locations of this valve system are within the reach of the skilled person, for instance with separate valves, of which at least one could possibly be located in the cylinder barrel 19, according to the user requirements.

Figures 4A, 4B, 4C:
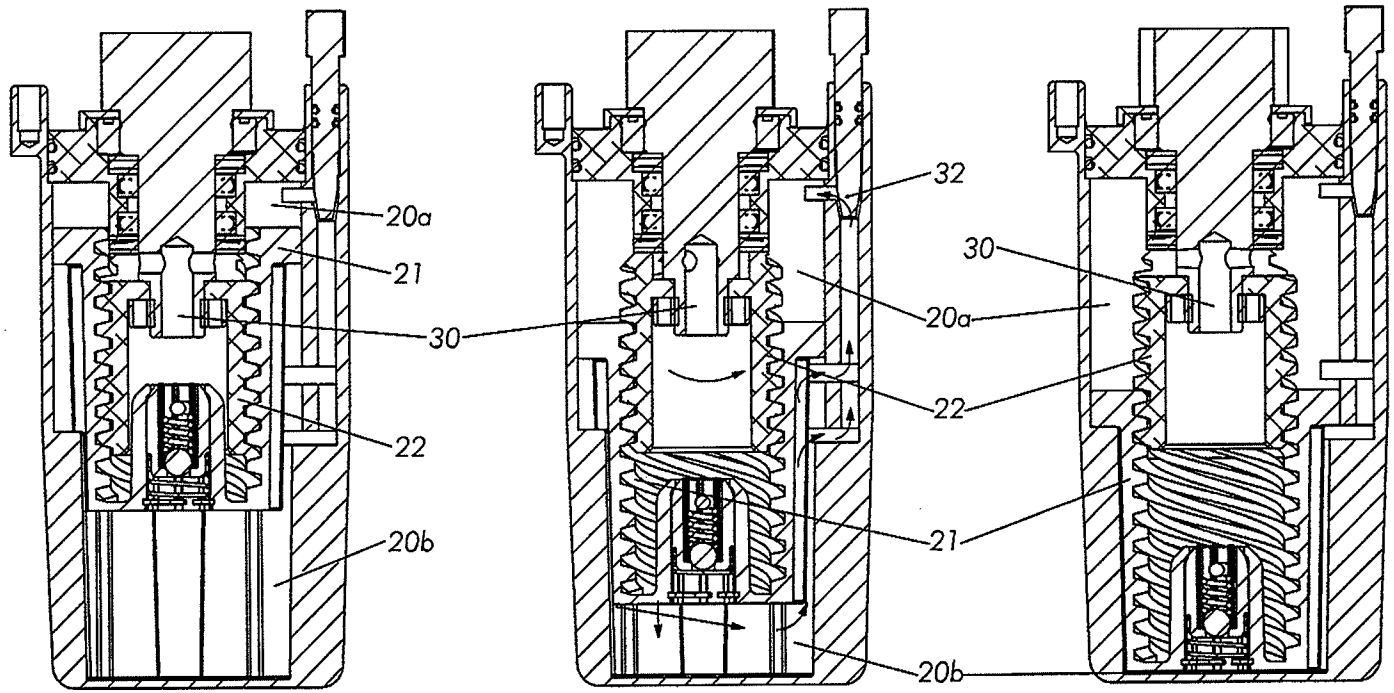

The fluid passage 31 also comprises a bypass 18 between a first, lower point 18*a* of the cylinder cavity 20, and a second, higher point 18*b* of the cylinder cavity 20. For most of the travel of the piston 21, both first and second points 18*a*, 18*b* will be below the piston 21, and thus on the same second, high pressure side 20*b* of the cylinder cavity 20, as shown in FIGS. 4*a* and 4*b*. However, when the piston 21 travels below the second point 18*b*, the bypass 18 will allow hydraulic fluid to bypass the needle valve 32, as shown in FIG. 4*c*, releasing the overpressure in the second side 20*b* and reducing (or even releasing) the damping torque of the hydraulic rotation damper 5.

Due to the presence of the one-way valve 33, the highest hydraulic fluid pressures will be reached in the second side 20*b* of the cylinder 20. Because the cylinder barrel 19 is cup-shaped, and completely closed at the bottom, in particular in the second, high pressure side 20*b* of the cylinder cavity 20, the illustrated hydraulic rotation damper 5 cannot leak, even when it is filled with a relatively low viscous hydraulic fluid which is particularly suited for outdoors applications, such as gate closing mechanisms. With the expression "completely closed in the second side of the cylinder cavity 20" is meant that the cylinder barrel does not have any opening allowing flow of fluid from the high-pressure second side 20*b* of the cylinder cavity 20 out of the damper. Although not preferred, it is also possible in the damper of the present invention to provide joints in the cylinder barrel 19 in the second side 20*b* of the cylinder cavity 20, but only in so far as those joints are not sliding joints between parts relatively movable tangentially to a joint surface. In an alternative embodiment, the bottom of the cylinder barrel could thus be a separate part affixed against the substantially cylindrical portion of the cylinder barrel, with a static seal pressed within the non-sliding joint formed between these two components. It is also possible to make a hole in the cylinder barrel for filling the cylinder cavity with the hydraulic fluid, and to close this hole in a completely fluid-tight manner by means of a screw plug.

Figures 3A, 3B, 3C, 3D:
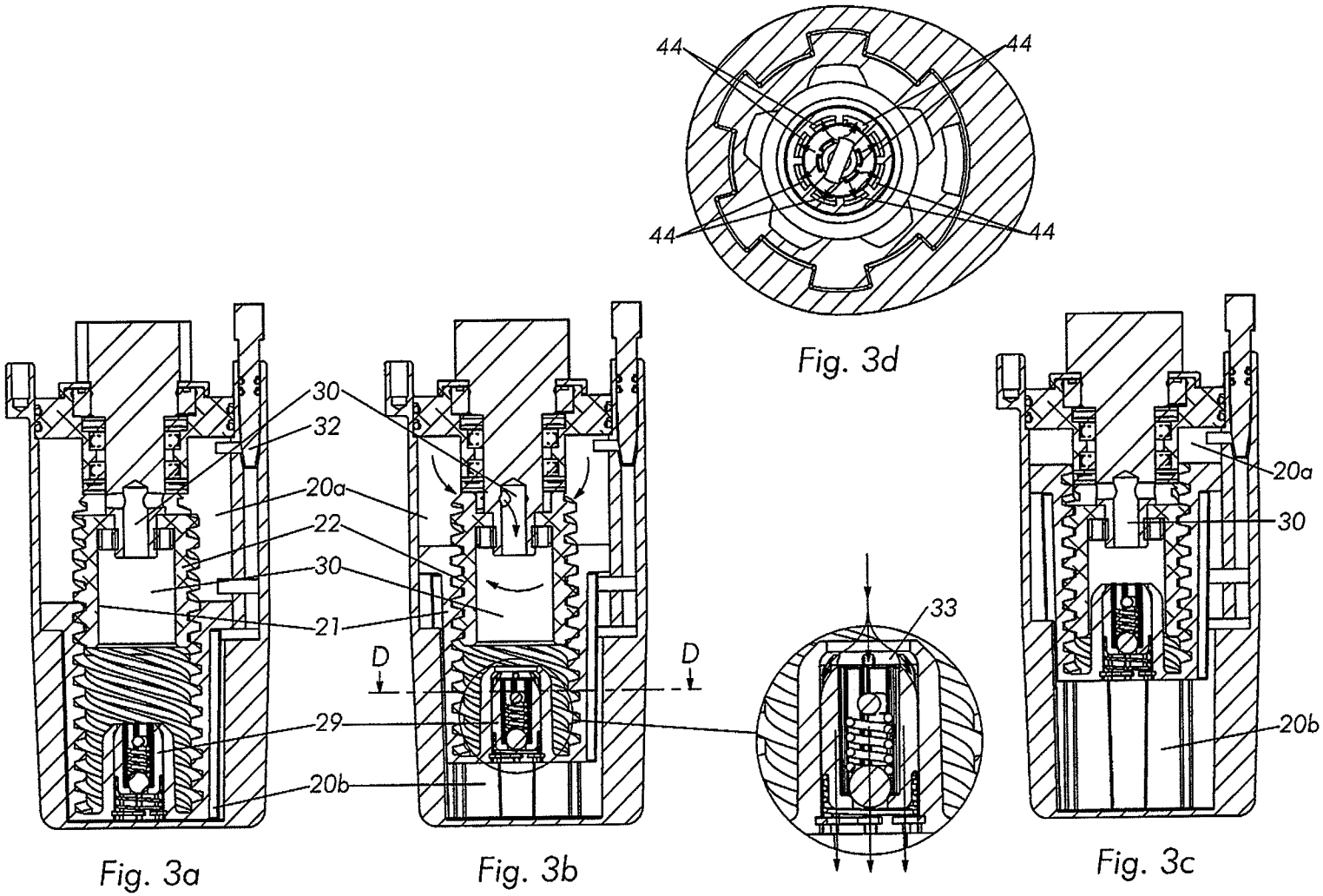

Turning to FIGS. 3*a* to 3*d*, if the damper shaft 22 is rotated by an external torque in a clockwise direction around axis Z, the piston 21 will move upwards. Since the one-way valve 33 is set to open when the pressure at the first side 20*a* of the cylinder 20 higher than that on the second side 20*b*, hydraulic fluid will flow from the first side 20*a*, through the piston cavity 28 and one-way valve 33, to the second side 20*b*, as shown in FIGS. 3*b*, 3*d*, and the rotation damper 5 will only oppose a small resistance to this movement. If the damper shaft 22 is rotated in the opposite, counter-clockwise direction around axis Z, as shown in FIGS. 4*a*-4*c*, the piston 21 will move downwards. Since the one-way valve 33 will now remain closed, the hydraulic fluid will flow back from the second side 20*b* to the first side 20*a* only through the clearance between the piston 21 and the cylinder barrel 19 and the restricted duct 31, and the rotation damper 5 will thus oppose a higher resistance to this return movement.

FIGS. 5*a* to 10*b* illustrate a closing mechanism comprising a linear actuator 49 with the rotation damper 5 already illustrated in FIG. 1.

Figure 6:
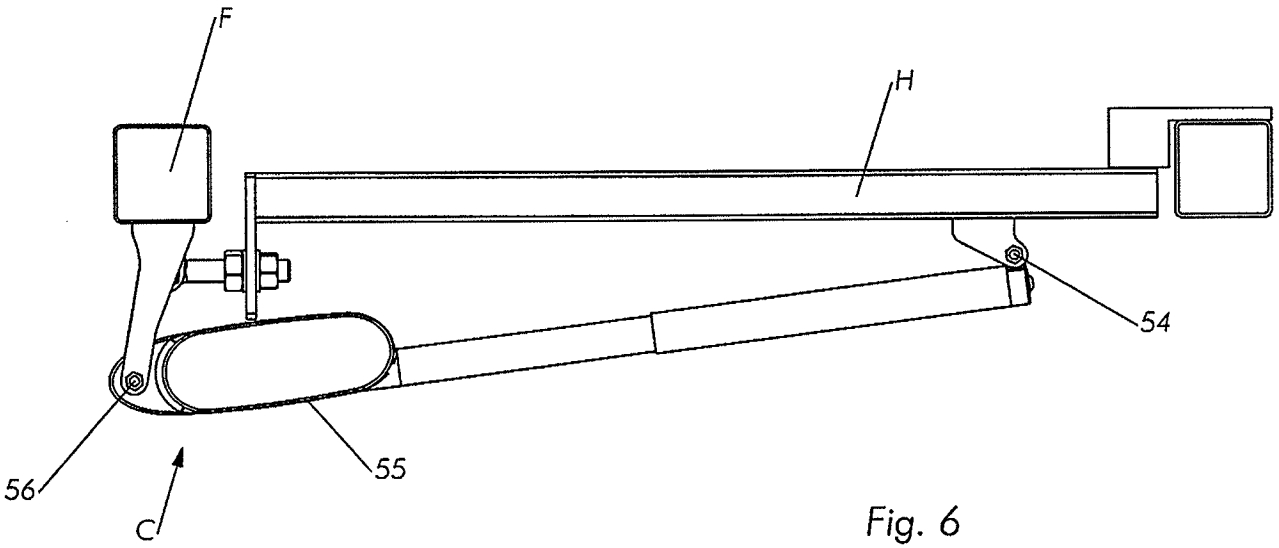
FIGS. 6 to 7 are top views of the gate closing mechanism of FIGS. 5*a*-5*b* applied to a gate represented respectively in its closed and open position.
Figure 7:
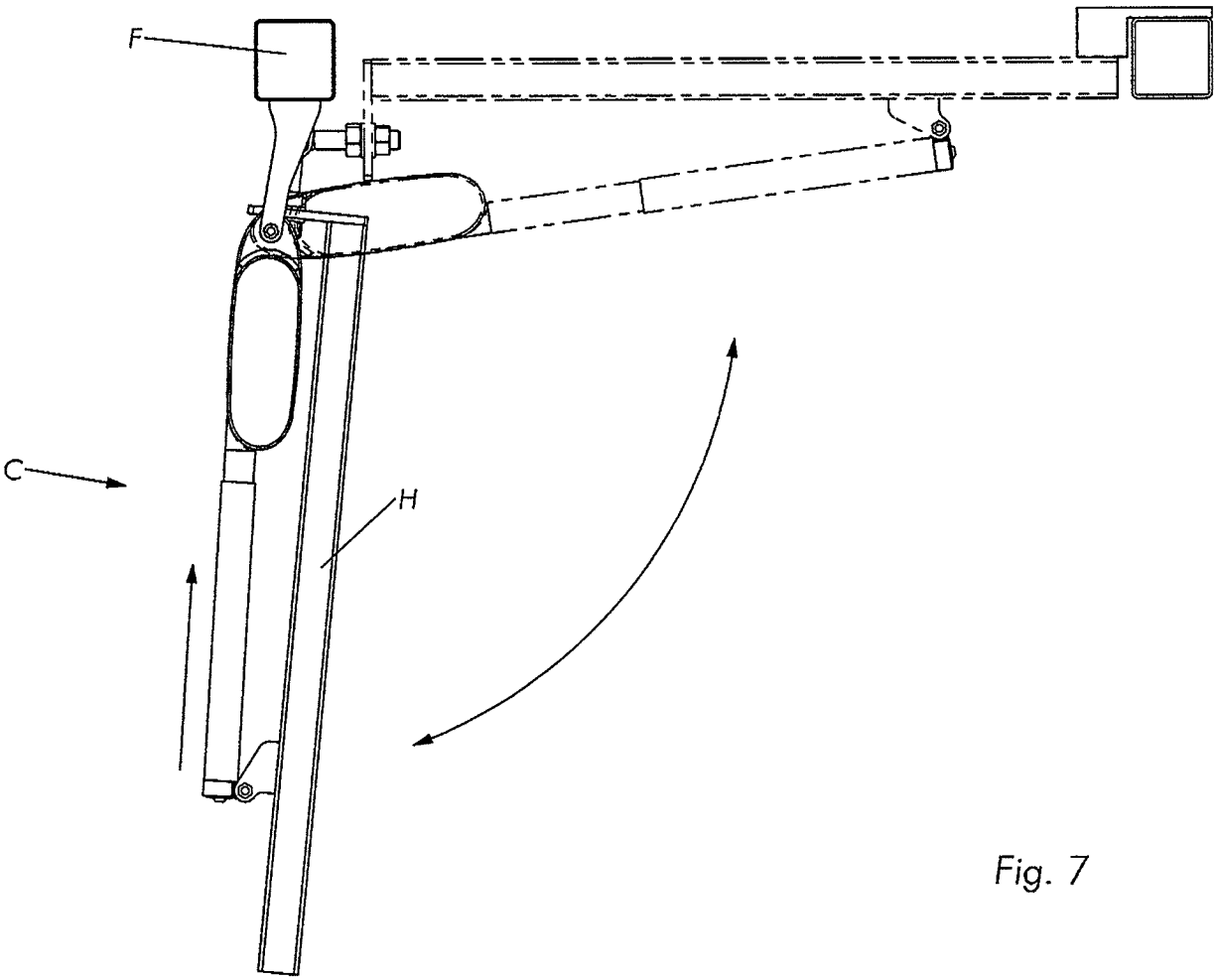
Figure 8:
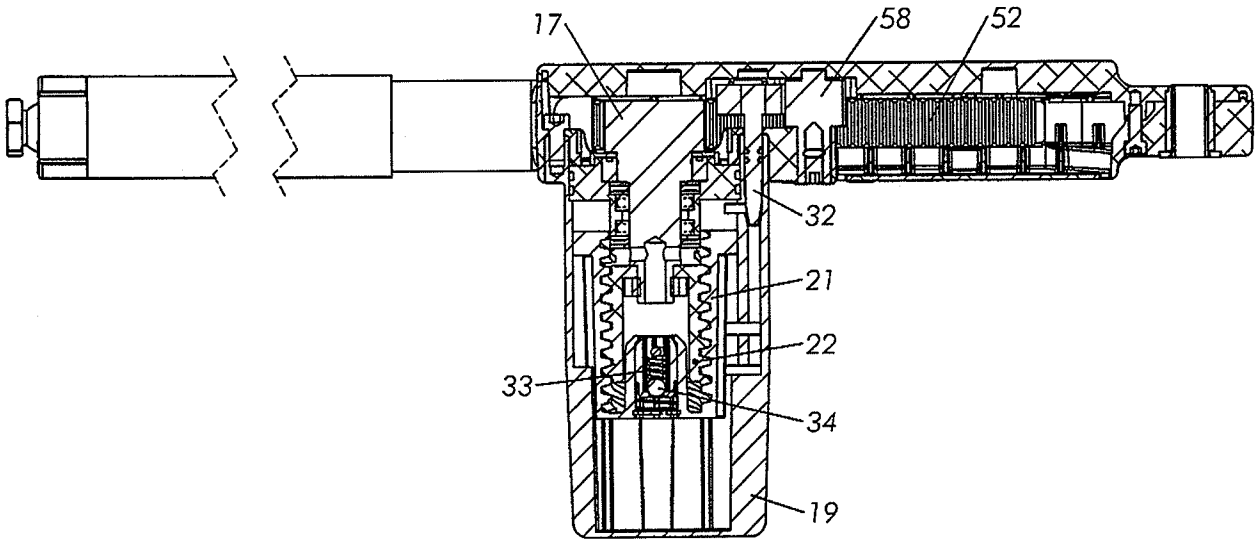
FIG. 8 is a detail cut view of the closing mechanism of FIGS. 5*a* and 5*b;*

The linear actuator 49 comprises a pushrod 50, a resilient element 51, in this particular embodiment in the form of a pressure coil spring, urging the pushrod 50 in an outwards direction along axis X, rotation damper 5, and a motion-converting mechanism, formed in this particular embodiment by a rack 52 formed on the pushrod 50 and the pinion 17, topping the damper shaft 22 and in engagement with the rack 52. A linear movement of the pushrod 50 in the outwards direction is converted into a counter-clockwise rotation of the damper shaft 22 around the axis Z, and thus in a downwards, highly damped motion of the piston 21. The opposite movement of the pushrod 50 will however be only slightly damped, since the piston 21 will move upwards. This linear actuator 49 can be for instance used in a telescopic closure mechanism C such as is illustrated in FIGS. 6 and 7, with a first pivot 54 at the distal end of the pushrod 50, and a housing 55 with an opposite second pivot 56, wherein the first and second pivots 54, 56 can be used to connect the closure mechanism C to, respectively, one or the other of a hinged member H or fixed frame F, as illustrated in FIGS. 6 and 7. Such closure mechanisms C can be used for hinged members opening in either direction: opening the hinged member H will always result in a contraction of the closure mechanism C and closing the hinged member H, in an extension of the closure mechanism C.

Figure 9:
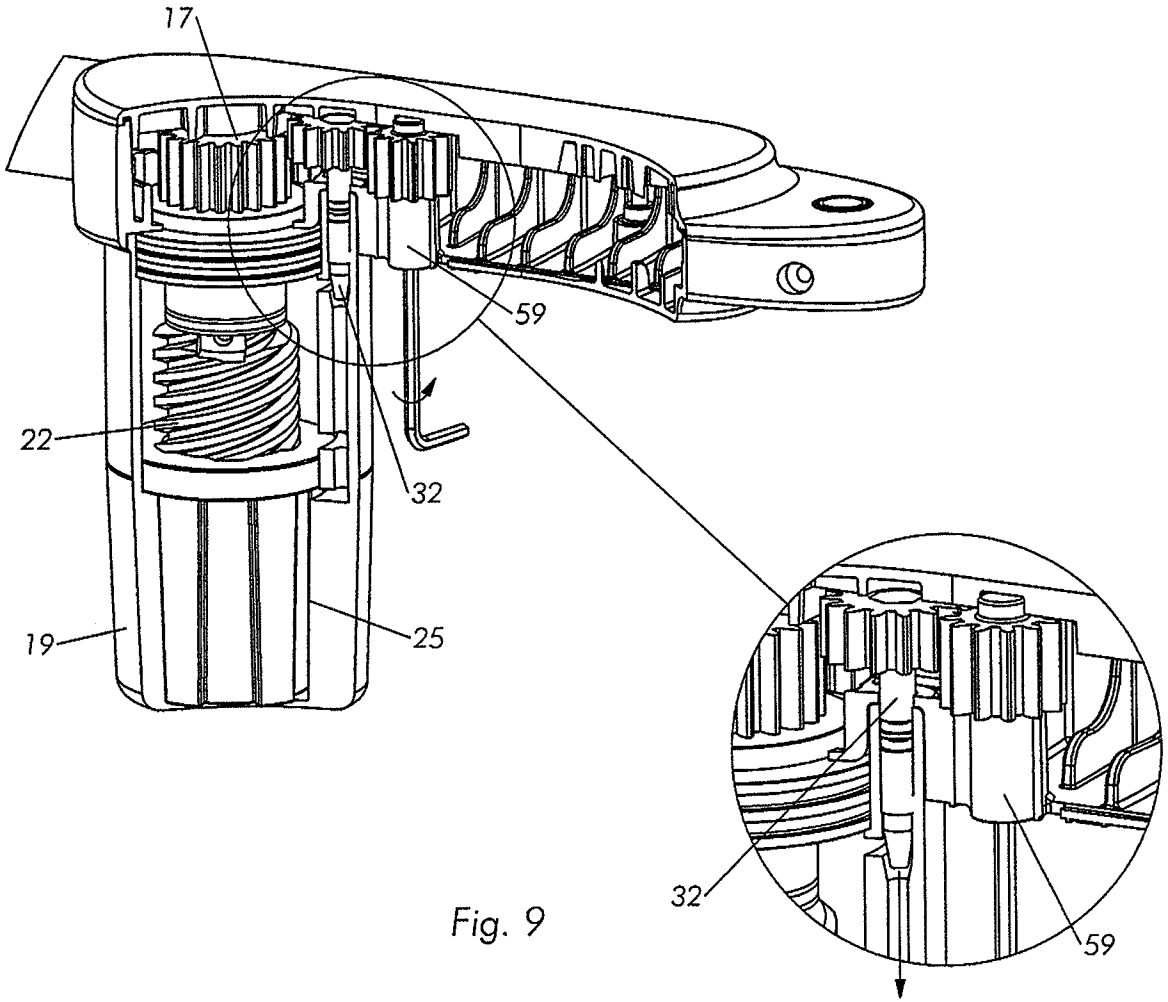
FIG. 9 is a detail perspective view of the closing mechanism of FIGS. 5*a* and 5*b;*

Since the housing 55 is fixed to the top of cylinder barrel 19, the needle valve 32 is not directly accessible. Instead, as seen in particular in FIGS. 9 and 10*a* to *b*, the needle valve 32 is coupled to a gearwheel 57 that is in engagement with a pinion 58 coupled to a small shaft 59. The small shaft 59 is accessible from the bottom of the housing 55 to adjust the needle valve 32. Any suitable means can be used to rotate the small shaft 59 to rotate the pinion 58, gearwheel 57 and hence adjust the needle valve 32. For example, an Allen key may be used as shown in FIG. 9.

Table 3 presents closing times at various temperatures of an example of such a linear actuator 49 comprising the above-mentioned test example of the rotation damper 5, with an aluminium barrel 19, a piston 21 injection-moulded from Hostaform® C9021, and Dow Corning® 200(R) 100 Cst hydraulic fluid.

TABLE 3

| Temperature and closing time | | | |
|---|---|---|---|
| Temperature [° C.] | −25 | 20 | 60 |
| Time [s] | 8 | 10 | 11 |

As can be seen in this table, despite the eight-fold decrease in viscosity of this hydraulic fluid over this 85 K temperature range, this example of the linear actuator 49 is actually slightly more strongly damped at high temperatures than at low ones.

An embodiment of a closing mechanism according to the invention comprising a rotational actuator 1 is illustrated in FIG. 11*a*. The illustrated actuator 1 has two alternative rotational outputs 2, 3, and an output arm 4 connectable to either one of the first rotational output 2 or second rotational output 3. Turning now to FIG. 11*b*, the first rotational output 2 is directly coupled to an output shaft 6, whereas the second rotational output 3 is coupled to the output shaft 6 over a reversing gearing 7. A torsion spring 8 is coupled to the output shaft 6 so as to urge it in a first, clockwise direction of rotation. In this manner, the output arm 4 will be urged in this first direction if it is coupled to the first output 2, as illustrated in FIG. 12*a*, and in an opposite, counter-clockwise direction if it is coupled to the second output 3 instead, as illustrated in FIG. 12*b*. Intermediate element 9 allows an adjustment of the angular position of the output arm 4 with respect to either output 2 or 3. As the angular position of the output arm 4 with respect to the first or second output 2, 3 is adjustable, a user can adjust at which angular position of the output arm 4 the release of the damping torque will take place, or even cancel it altogether.

The output arm 4 presents, on its underside, a translational guide (not illustrated) for engaging a roller 16. This rotational actuator 1 can thus be used as a closure mechanism for a closure member, such as a door, gate, or wing, hinged to a fixed frame. The rotational actuator 1 could be mounted on the fixed frame, and the roller 16 fixed to the hinged member. Alternatively, the output arm 4 could present a roller at a distal extremity, and a translational roller guide be mounted on the hinged member. Either way, the rotational actuator 1 could be adapted to right- or left-hand opening members by coupling the output arm 4 to either the first or second outputs 2, 3. In FIGS. 12*c* and 12*d*, the actuator 1 in, respectively, the arrangements of FIGS. 12*a* and 12*b*, is shown forming a closing mechanism interposed between a hinged member H and a fixed frame F. In both cases, a member carrying the roller 16 is fixed to the hinged member H, and the rotational actuator 1 is fixed to the fixed frame F.

The output shaft 6 is also coupled to a hydraulic rotation damper 5 for damping its rotation in the first, clockwise direction. Turning now to FIG. 13, which shows an exploded view of the rotational actuator 1, the lower end of the output shaft 6 is coupled in rotation to a lower block 10, to which the lower end of the torsion spring 8 is also connected. The upper end of the torsion spring is connected to an upper block 11 in engagement with a finger 12. This is shown in detail in FIGS. 13*a* to 13*c*. The upper end of the output shaft 6 is coupled in rotation to a cam plate 13, which rotation in the first direction is limited by a corresponding stop in the housing of the actuator 1. By varying the angular position in the housing of the upper block 11 through adjustment of the finger 12 over a screw 14, it is possible to preload the torsion spring 8.

The lower block 10 is in the shape of an inverted cup, forming, on its inside, a ring gear in engagement with planet gears 15, which in turn engage a pinion 17 fixed to the damper shaft 22 of the hydraulic rotation damper 5 and acting as a sun gear. The rotation of the output shaft 6 is thus inversed and transmitted to the damper shaft 22 over a planetary gearing with a multiplication ratio of, for example, 2, preferably 3. In the illustrated actuator, the pinion 17 has 12 teeth, and the ring gear of the lower block 10 has 36 teeth, resulting in a multiplication ratio of 3.

In the embodiment of the closing mechanism C described above, the movement of the piston 19 is substantially parallel to the axis of rotation of the output shaft 6 of the closing mechanism (FIG. 13). However, alternative damper and actuation configurations are possible using the principles of the hydraulic damper as described above with reference to FIGS. 1*a* to 4*c* above.

FIGS. 14 to 15*b* illustrate the operation of another embodiment of a closing mechanism in accordance with the present invention. FIG. 14 illustrates a hydraulic damper 60 that is attached to a shaft 62 that rotates about an axis 64. The shaft 62 is connected to the damper 60 by means of a rack-and-pinion transmission as will be described in more detail with reference to FIGS. 15*a* and 15*b* below. A needle valve 66 is provided in the body of the damper 60 that corresponds to needle valve 32.

FIGS. 15*a* and 15*b* illustrate the inside of the hydraulic damper 60 during an opening and a closing motion respectively of the closing mechanism (not shown). In FIGS. 15*a* and 15*b*, the damper 60 comprises a cylinder barrel 68 that defines a cavity 70 within which a piston 72 is located. A compression spring 74 is also located in the cavity 70 to bias the piston 72 towards a first position (FIG. 15*a*). However, it will be appreciated that the compression spring 74 can be replaced with a torsion spring located external to the damper 60.

As described above, the cylinder barrel 68 is made of a first material having a first thermal expansion coefficient and the piston 72 is made of a second material having a second thermal expansion coefficient that is larger than the first thermal expansion coefficient.

The piston 72 has a cavity 76 in which a rack 78 located on an internal wall 80. The shaft 62 carries a pinion 82 at one end that locates within the cavity 76 and engages the rack 78 as shown. Rotational movement of the shaft 62 is converted into translational movement of the piston 72 in a direction that is perpendicular to axis 64.

The piston 72 divides the cavity 70 to provide a first side 70*a* and a second side 70*b*. The piston 72 has an outer perimeter surface that defines a clearance (not shown) between an inner perimeter surface of the cavity cylinder barrel 68 within the cavity 70. This clearance provides a path for fluid flow between the first and second sides 70*a*, 70*b* of the cavity 70. The clearance decreases when the temperature of the damper 60 is raised and increases when the temperature is lowered due to the piston 72 and cylinder barrel 68 having different thermal expansion coefficients. This has been described above in detail with reference to FIGS. 1*a* to 4*c*.

The first and second sides 70*a*, 70*b* of the cavity are in fluid communication with one another by means of a duct 84 that is restricted by the needle valve 66. A one-way valve 86 is also provided for allowing the flow of fluid from the first side 70*a* to the second side 70*b* of the cavity 70 through cavity 76 of the piston 72 and ducts 88 and 90, the one-way valve 86 being positioned within the duct 88 as shown.

As shown in FIG. 15*a*, when the shaft 64 is rotated in a clockwise direction, the piston 72 is moved in a direction against the action of the spring 74 as shown by arrow 92. The one-way valve 86 allows hydraulic fluid to flow from the first side 70*a* to the second side 70*b* of the cavity 70 opposing resistance to the movement of the piston 72.

Once the shaft 62 no longer rotates in the clockwise direction and is released, the spring 74 pushes the piston 72 back in the direction shown by arrow 94 in FIG. 15*b*. As the one-way valve 86 does not allow flow from the second side 70*b* to the first side 70*a*, all the returning hydraulic fluid has to flow through the duct 84 in which the needle valve 66 is located. This dampens the returning movement of the piston 72 and the mechanism (not shown) that is attached to the shaft 62.

Adjustment of the needle valve 66 controls the rate of flow of the hydraulic fluid through the duct 84 and hence the dampening effect provided by the damper 60 as the piston moves in the direction of arrow 92.

It will readily be appreciated that the mechanism described above can be mounted on the hinged member, such as, a door, a window or a gate, as well as being mounted on a post in accordance with the particular application. Moreover, the hinged member may comprise items other than those described above.

Although the present invention has been described with reference to specific exemplary embodiments, it will be evident that various modifications and changes may be made to these embodiments without departing from the broader scope of the invention as set forth in the claims. For instance, although the invention has been illustrated with embodiments relating only to rotational dampers, it could also be applied to linear hydraulic dampers in which the damper shaft follows the linear movement of the piston. Accordingly, the description and drawings are to be regarded in an illustrative sense rather than a restrictive sense.

The invention claimed is:

1. A hydraulic damper (5; 60) for closing a hinged member (H) comprising:

a cylinder barrel (19; 68);

a closed cylinder cavity (20; 70) formed within the cylinder barrel (19; 68);

a piston (21; 72) placed within the closed cylinder cavity (20; 70) so as to divide the closed cylinder cavity (20; 70) into a first side (20*a*; 70*a*) and a second side (20*b*; 70*b*); and a damper shaft (22; 62) coupled to the piston (21; 72) for dampening closing movement of the hinged member, wherein, at least at 20° C., an outer perimeter surface of the piston (21; 72) defines a clearance between an inner perimeter surface (27) of the cylinder barrel (19) to allow hydraulic fluid contained in the cylinder cavity (20; 70) to flow through the clearance between the outer perimeter surface of the piston (21; 72) and the inner perimeter surface of the cylinder barrel (19) between the first side (20*a*; 70*a*) and the second side (20*b*; 70*b*) of the closed cylinder cavity (20; 70), wherein the cylinder barrel (19; 68) is made of a first material, having a first thermal expansion coefficient and the piston (21; 72) is made of a second material having a second thermal expansion coefficient, the second thermal expansion coefficient being larger than the first thermal expansion coefficient so that the clearance decreases when the temperature of the damper (5; 60) is raised and increases when the temperature of the damper (5; 60) is lowered, and wherein the difference between the first and second thermal expansion coefficients is at least $1.5\times10^{-5}$ $K^{-1}$.

2. The hydraulic damper (5; 60) according to claim 1, wherein the second material comprises a synthetic material.

3. The hydraulic damper (5; 60) according to claim 2, wherein the synthetic material comprises polyoxymethylene (POM).

4. The hydraulic damper (5; 60) according to claim 1, wherein a press fit is provided between the piston (21; 72) and the cylinder barrel (19; 68) when the temperature of the damper (5; 60) rises above a predetermined temperature, the predetermined temperature being higher than 25° C.

5. The hydraulic damper (5; 60) according to claim 1, wherein a minimum cross-sectional area of the clearance between the piston (21; 72) and the cylinder barrel (19; 68), measured in a plane perpendicular to a longitudinal axis of the cylinder cavity (20; 70) increases by at least 10%.

6. The hydraulic damper (5; 60) according to claim 1, further comprising a restricted fluid passage (31; 84) between the first and second sides (20*a*, 20*b*; 70*a*, 70*b*) of the closed cylinder cavity (20; 70).

7. The hydraulic damper (5; 60) according to claim 6, wherein the restricted fluid passage (31; 84) has a cross-section, at its narrowest point, that is not larger than at most five times a minimum cross-sectional area of the clearance between the piston (21; 72) and the cylinder barrel (19; 68), measured in a plane perpendicular to the longitudinal axis of the closed cylinder cavity (20; 70) at 20° C.

8. The hydraulic damper (5; 60) according to claim 6, wherein the restricted fluid passage (31; 84) comprises an adjustable flow restrictor (32; 66).

9. The hydraulic damper (5) according to claim 6, further comprising a substantially unrestricted bypass (18) from a first lower point (18*a*) of the closed cylinder cavity (20) to a second higher point (18*b*) of the closed cylinder cavity (20) for bypassing the restricted fluid passage (31), the first lower point being below the second higher point.

10. The hydraulic damper (5; 60) according to claim 1, further comprising a one-way valve (33; 86) allowing fluid flow from the first side (20*a*; 70*a*) to the second side (20*b*; 70*b*) of the closed cylinder cavity (20; 70).

11. The hydraulic damper (5) according to claim 1, further comprising a relief valve (34) located between the second side (20*b*) and the first side (20*a*) of the closed cylinder cavity (20), the relief valve (34) being set to open when an overpressure in the second side (20*b*) exceeds a predetermined threshold and close again once the overpressure falls back under the same, or a lower predetermined threshold.

12. The hydraulic damper (5) according to claim 1, wherein the cylinder barrel (19) comprises a cup-shaped barrel having a closed portion and an open portion that is closed by a lid (35) to form the closed cylinder cavity (20).

13. The hydraulic damper according to claim 12 wherein the damper shaft (22) is located on the first side (20*a*) of the cylinder cavity (20) within the cylinder barrel (19), the damper shaft (22) extending through the lid (35) and being sealed to the lid (35) by means of a shaft seal applied thereround.

14. The hydraulic damper according to claim 13, wherein the hydraulic damper (5) comprises a rotation damper, and the piston (21) comprises:

at least one helical thread (23) for engaging a corresponding thread (24) formed either on the damper shaft (22) or on the cylinder barrel (19); and a rotation-preventing member (25), preventing either rotation between the piston (21) and the cylinder barrel (19) or between the piston (21) and the damper shaft (22) so that rotational motion of the damper shaft (22) with respect to the cylinder barrel (19) around a longitudinal axis (Z) of the damper shaft (22) results in a translational motion of the piston (21) along the longitudinal axis (Z).

15. The hydraulic damper according to claim 13, wherein the damper shaft (22) includes a rotary output element (17) coupled to the damper shaft (22) and located outside of the closed cylinder cavity (20).

16. The hydraulic damper according to claim 1, wherein the damper shaft (62) is rotatable about an axis (64) that extends into a cavity (76) formed in the piston (72), the damper shaft (62) having a pinion (82) that engages with a rack (78) formed in the cavity (76) to convert rotational movement of the damper shaft (62) into translational movement of the piston (72) within the closed cylinder cavity (70).

17. The hydraulic damper according to claim 16, further including a return member (74) against which the piston (72) is urged from a neutral position by rotation of the damper shaft (62), the return member (74) returning the piston (72) to the neutral position when the damper shaft (62) is released.

18. A hydraulic damper (5; 60) for closing a hinged member (H) comprising:

a cylinder barrel (19; 68);

a closed cylinder cavity (20; 70) formed within the cylinder barrel (19; 68);

a piston (21; 72) placed within the closed cylinder cavity (20; 70) so as to divide the closed cylinder cavity (20; 70) into a first side (20*a*; 70*a*) and a second side (20*b*; 70*b*); and a damper shaft (22; 62) coupled to the piston (21; 72) for dampening closing movement of the hinged member, wherein, at least at 20° C., an outer perimeter surface of the piston (21; 72) defines a clearance between an inner perimeter surface (27) of the cylinder barrel (19) to allow hydraulic fluid contained in the cylinder cavity (20; 70) to flow through the clearance between the outer perimeter surface of the piston (21; 72) and the inner perimeter surface of the cylinder barrel (19) between the first side (20*a*; 70*a*) and the second side (20*b*; 70*b*) of the closed cylinder cavity (20; 70), wherein the cylinder barrel (19; 68) is made of a first material, having a first thermal expansion coefficient and the piston (21; 72) is made of a second material having a second thermal expansion coefficient, the second thermal expansion coefficient being larger than the first thermal expansion coefficient so that the clearance decreases when the temperature of the damper (5; 60) is raised and increases when the temperature of the damper (5; 60) is lowered, and wherein a minimum cross-sectional area of the clearance between the piston (21; 72) and the cylinder barrel (19; 68), measured in a plane perpendicular to a longitudinal axis of the cylinder cavity (20; 70) increases by at least 10%.

19. The hydraulic damper (5; 60) according to claim 18, wherein the second material comprises a synthetic material.

20. The hydraulic damper (5; 60) according to claim 19, wherein the synthetic material comprises polyoxymethylene (POM).

21. The hydraulic damper (5; 60) according to claim 18, wherein a press fit is provided between the piston (21; 72) and the cylinder barrel (19; 68) when the temperature of the damper (5; 60) rises above a predetermined temperature, the predetermined temperature being higher than 25° C.

22. The hydraulic damper (5; 60) according to claim 18, further comprising a restricted fluid passage (31; 84) between the first and second sides (20*a*, 20*b*; 70*a*, 70*b*) of the closed cylinder cavity (20; 70).

23. The hydraulic damper (5; 60) according to claim 22, wherein the restricted fluid passage (31; 84) has a cross-section, at its narrowest point, that is not larger than at most five times a minimum cross-sectional area of the clearance between the piston (21; 72) and the cylinder barrel (19; 68), measured in a plane perpendicular to the longitudinal axis of the closed cylinder cavity (20; 70) at 20° C.

* * * * *